US007550399B2

(12) United States Patent
Kimbrell, Jr. et al.

(10) Patent No.: US 7,550,399 B2
(45) Date of Patent: Jun. 23, 2009

(54) WASH-DURABLE, LIQUID REPELLENT, AND STAIN RELEASING COTTON FABRIC SUBSTRATES

(75) Inventors: William C. Kimbrell, Jr., Spartanburg, SC (US); Xinggao Fang, Duncan, SC (US); Yunzhang Wang, Duncan, SC (US); Dominick J. Valenti, Greer, SC (US); Daniel T. McBride, Chesnee, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 12/075,358

(22) Filed: Mar. 11, 2008

(65) Prior Publication Data

US 2008/0160850 A1 Jul. 3, 2008

Related U.S. Application Data

(63) Continuation of application No. 10/339,911, filed on Jan. 10, 2003, now abandoned.

(51) Int. Cl.
*B32B 5/02* (2006.01)
*B32B 15/18* (2006.01)
*D03D 15/00* (2006.01)

(52) U.S. Cl. ..... 442/93; 442/181; 442/226

(58) Field of Classification Search ..... 442/93, 442/94, 181, 226, 79, 80, 82
See application file for complete search history.

(56) References Cited

U.S. PATENT DOCUMENTS 7,468,333 B2 * 12/2008 Kimbrell et al. ..... 442/94

* cited by examiner

*Primary Examiner*—Lynda Salvatore
(74) *Attorney, Agent, or Firm*—Brenda D. Wentz

(57) ABSTRACT

The present invention relates generally to substrates that exhibit useful, auto adaptable surface energy properties that depend on the environment of the substrate. Such surface energy properties provide relatively high advancing and receding contact angles for liquids when in contact with the target substrate surface. The substrates exhibit low surface energy quantities of at most about 20 millijoules per square meter ($mJ/m^2$) at a temperature of about 25 degrees C. and a surface energy greater than about 20 $mJ/m^2$ at, or with exposure to, a temperature of about 40 degrees C. More specifically, encompassed within the present invention are textile substrates having this highly desirable unique surface energy modification property and which exhibit wash durable oil and water repellency and stain release features. Novel compositions and formulations that impart such surface energy modifications to substrates are also encompassed within this invention, as well as methods for producing such treated substrates.

9 Claims, 1 Drawing Sheet

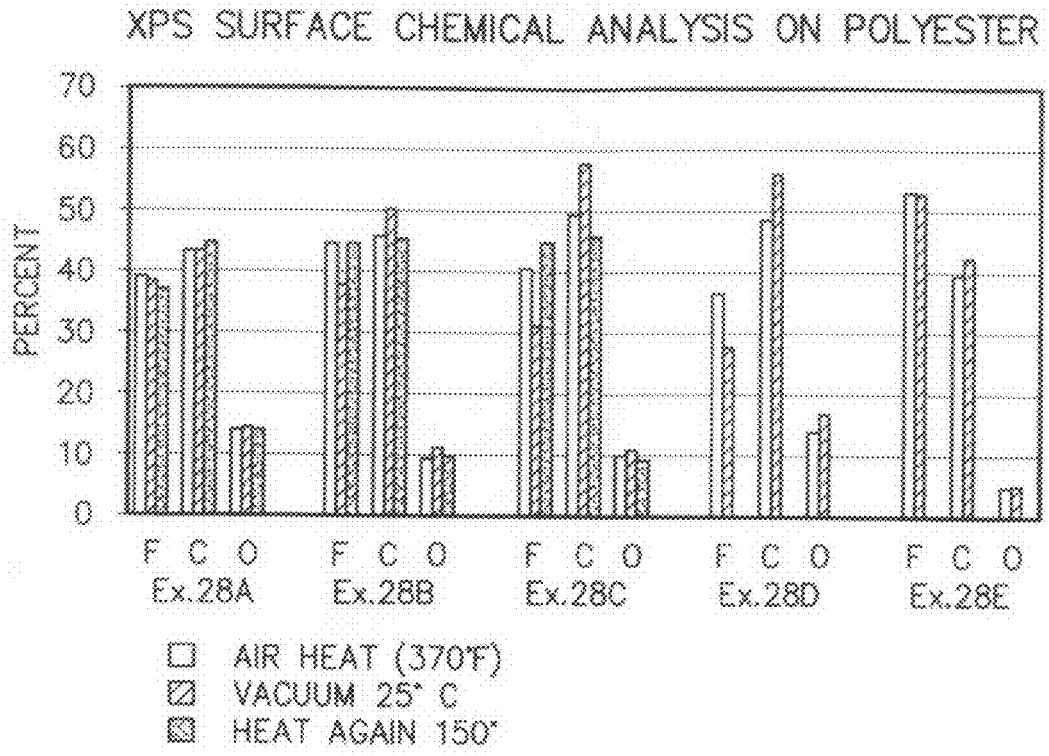
FIG. —1—
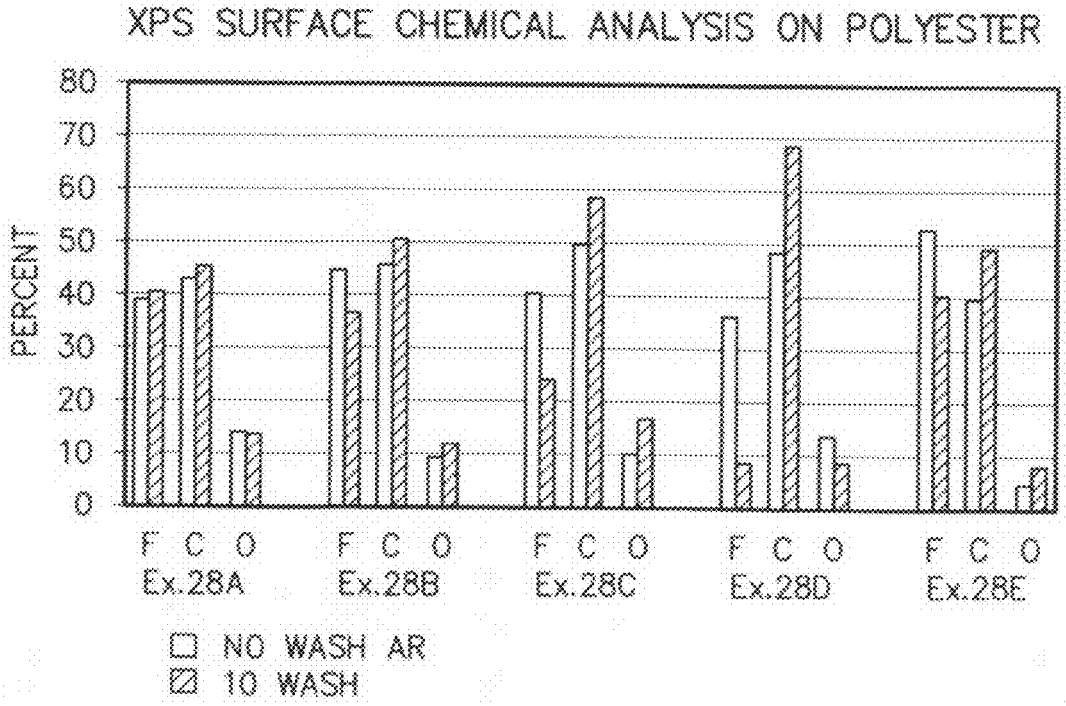
FIG. —2—

WASH-DURABLE, LIQUID REPELLENT, AND STAIN RELEASING COTTON FABRIC SUBSTRATES

CROSS-REFERENCE TO RELATED APPLICATIONS

This application claims priority to and is a continuation U.S. Pat. application Ser. No. 10/339,911 filed on Jan. 10, 2003, now abandoned. The priority application is hereby entirely incorporated by reference.

FIELD OF THE INVENTION

The present invention relates generally to substrates that exhibit useful, auto adaptable surface energy properties that depend on the environment of the substrate. Such surface energy properties provide relatively high advancing and receding contact angles for liquids when in contact with the target substrate surface. In particular, the substrates exhibit low surface energy quantities of at most about 20 millijoules per square meter ($mJ/m^2$), as measured by Goniometry and calculated by Fowkes equation, at a temperature of about 25 degrees C. and a surface energy greater than about 20 $mJ/m^2$ at, or with exposure to, a temperature of about 40 degrees C. This unique ability for automatic surface energy modification, in turn, provides surfaces that are water and oil repellent, that exhibit certain degrees of stain resistance, and that impart effective stain release properties to the target substrate. In addition, this unique surface energy profile is repeatable and reversible depending on the exposure environment. Novel compositions and formulations that impart such surface energy modifications to substrates are also encompassed within this invention, as well as methods for producing such treated substrates. More specifically, encompassed within the present invention are textile substrates having this highly desirable unique surface energy modification property and which exhibit wash durable oil and water repellency and soil and/or stain release features.

BACKGROUND OF THE INVENTION

It has long been a necessity, particularly within the textile industry, to provide substrates, such as apparel fabrics, as one example, that exhibit a number of simultaneous wash-durable properties. Most notably, water repellency, oil repellency, stain resistance, and stain release characteristics are highly desirable to facilitate cleaning of substrates, if not to prevent complete staining thereof. Unfortunately, provision of such simultaneous and wash-durable characteristics has been severely limited due to the general difficulties with meeting certain surface energy requirements throughout the wash-durable life of such a substrate. Generally, coatings or other treatments have not been readily available or widely known that can provide coexistent water and oil repellency and stain release on a wash durable basis to fabrics (or other surfaces) because the surface energy profile required for one of these properties is disparately different from the surface energy profile required to impart the other property at the same time.

Although there have been some instances of initial simultaneous existence of both properties on certain substrates (as noted below), unfortunately, the degree of wash-durability thereof has been unacceptable for long-term utilization of target substrates. As a result, any significant reduction in either oil or water repellency consequently reduces stain repellency as well. With a reduced propensity to repel stains, the ability to effectuate proper stain release may likewise be diminished, particularly upon exposure to greater degrees of staining and wherein the surface energy profile needed for proper stain release function (which is similar to that needed to impart the aforementioned water and oil repellency properties) is compromised (e.g., is not wash-durable).

Hence, truly effective wash-durable, long-term, stain repellent and stain release treatments have not been forthcoming, since simultaneous prevention of both polar (aqueous) and non-polar (olefinic) liquid penetration into such fabric surfaces has been very difficult to achieve that can withstand extended common laundering procedures. This problem with prior oil and water repellent surface treatments is most prominently observed on typical high stain substrates such as cotton-containing fabrics. Such fabrics are generally difficult to modify at their surfaces to the extent necessary to impart both oil and water repellent features thereto and to retain an acceptable hand. These at least three properties (stain release, water repellency, and oil repellency) are simply unavailable to the textile industry on a wash-durable basis due to the aforementioned surface energy issues. A description of such surface energy properties helps to permit a better understanding of such a phenomenon.

A fundamental physical property of any material is its surface energy. This property is usually expressed in $mJ/m^2$. Depending on the magnitude of this property, the material may be classified as having a high surface energy or a low surface energy. This property depends generally on the composition of the substrate. For example, a substrate having a surface that contains a significant portion of polar, hydrophilic groups, such as hydroxyl groups, carboxylic acid groups, amine groups, and the like, generally exhibits a high surface energy. Conversely, a substrate having a surface that contains a significant portion of non-polar, hydrophobic groups, such as silicone, fluorinated groups, and the like, generally exhibits a low surface energy. It is readily known that when a polar liquid, such as water, is placed in contact with the surface of a substrate, the liquid will spontaneously wet the surface only if the surface tension of the liquid is lower than the surface energy of the substrate. Conversely, if the surface tension of the liquid is higher than the surface energy of the substrate, spontaneous wetting will not readily occur, and the liquid will remain pooled on the surface of the substrate.

As one might expect then, substrate surface energy modification has long been a major field of research for a variety of materials and for a multitude of reasons. For instance, it is often desirable to increase the surface energy of a substrate to facilitate its ability to absorb liquid or to increase the adhesion between a coating and a substrate. Practical examples include the chemical treatment of paper or plastic to enhance their wetting with printing inks and corona treatment of plastic to increase the adhesion between the plastic and another material, such as for the aluminum coating of Mylar® films in packaging applications. Textile substrates have also been modified to create substrates with high surface energy which results in a textile substrate that is hydrophilic and that exhibits improved comfort and stain release properties. As one example, the detergent industry has employed this technique for determining effective methods of cleaning various textile substrates.

Surface energy modification has also been utilized in other coating applications, such as to produce non-stick surfaces exhibiting low surface energy through the application of Teflon™ to cookware and cooking utensils. Textile substrates have also been modified with low surface energy treatments in order to produce textile substrates that are hydrophobic and that exhibit repellent properties (such as for water repellent rainwear).

It has commonly been observed that substrates treated with fluorinated polymers generally exhibit a contact angle of greater than 100 degrees with water. The advancing and receding contact angles are very similar. The major component of the surface energy of such treatments is dispersive. Substrates treated with dual functional repellents, such as disclosed in U.S. Pat. No. 3,574,791 to Sherman et al., generally exhibit lower contact angles with water when compared with traditional fluorochemical repellents, and therefore, tend to exhibit lower repellency. The measured surface energy contains significant dispersive and polar components. Differences can usually be measured between the advancing and receding contact angles.

In some instances, a measurable degree of hysteresis exists between the advancing and receding contact angle, indicating that the surface energy has changed in the presence of a liquid. Barring liquid adsorption, hysteresis is indicative that the surface energy has changed (kinetically or thermodynamically) in the presence of a liquid or environmental condition. This measurable degree of hysteresis provides further evidence that the substrate is autoadapting to its environment. One method for achieving ideal performance for textile applications would be obtained from a composition that provides high advancing contact angles (i.e., >90 degrees), exhibiting non-porous behavior, to impart stain resistance and provides low receding contact angles (i.e., <90 degrees), exhibiting porous behavior, to impart stain release to the substrate. Another method to achieve ideal performance for such applications would be obtained from a composition that imparts high advancing and high receding contact angles between a staining substance and the substrate, followed by low advancing and receding contact angles during exposure to a cleaning procedure.

It would be desirable for a porous or stainable surface to exhibit high contact angles versus a variety of liquids to prevent adsorption or staining. It would also be desirable for such surfaces to adapt to a change in their environment, such as in a cleaning medium, to enhance removal of stains and soil. Other environmental conditions that could induce a change in the surface energy of a substrate include changes in temperature, moisture content, and other environmental factors. Highly desirable would be a surface that reversibly adapts to its environment, such that the surface is stain resistant and cleanable and retains this effect through a number of use cycles. In many end-use applications such as apparel, carpet, upholstery, and the like, appearance retention of the product is extremely important. While stain resistant treatments have been developed for each of these exemplary applications, it has been found, that much like stain resistant apparel treatments, such treatments have an adverse effect on subsequent cleaning. Thus, it would be highly desirable to develop soil and stain resistant textile substrates, regardless of the end-use application, that possess enhanced cleanability using appropriate cleaning techniques.

With the development of XPS, SIMS, and other surface analytical techniques, it has become possible to detect certain chemical groups at the surface of materials. For instance, one can measure the concentration and depth profile of functional groups, such as $CF_3$ moieties commonly found in fluoropolymer stain resist chemicals. Through appropriate sample preparation techniques, it is also possible to observe changes that take place on the surface of a substrate and that occur as a result of changes in the environment to which the substrate is exposed. For example, a substrate that is observed to contain predominately low surface energy groups, such as $CF_3$ groups, under a first set of conditions can be shown to contain significant hydrophilic high surface energy groups, such as hydroxyl groups, at its surface under a different, second set of conditions. This polarity change typically allows the surface of the substrate to wet (i.e., absorb liquid), thereby enhancing stain release. As the substrate's environment is returned to the first set of conditions, one can observe, for example, the $CF_3$ groups return to the substrate's surface, thus, returning the substrate to its low surface energy, stain resistant state.

Some treatment compositions, such as polymers, possess other properties, such as glass transition temperature, which may influence the ultimate performance of the treated substrate. For instance a hard polymer that is characterized by a high glass transition temperature may provide increased protection against wetting, especially forcibly wetting. However, this stiff, high glass transition polymer would likely require more work to adapt to changes in its environment due to less intra-polymer flexibility. In addition, the polymer molecular weight and addition of co-monomers may enhance wetting, adhesion, chemical reactivity, and durability for a variety of substrates as well.

As should thus be evident, modification to provide a proper surface energy profile to impart simultaneous wash-durable oil repellency, water repellency, stain resistance, and stain release properties to a target substrate has been sought after for many years without success.

The invention as described herein illustrates that certain combinations of chemicals and processing conditions permit and/or facilitate tailoring of the surface properties of a target substrate to obtain the desired balance of surface energy profiles to impart simultaneous repellency and stain release characteristics thereto. Furthermore, this unique combination of features has surprisingly been shown to be quite durable upon exposure to routine as well as industrial cleaning methods.

DESCRIPTION OF THE PRIOR ART

All U.S. Patents listed below are herein entirely incorporated by reference.

U.S. Pat. No. 2,841,573 to Ahlbrecht, et al. and U.S. Pat. No. 3,645,990 to Raynolds disclose the use of fluoropolymers to impart oil and water resistance to textile substrates. While indeed providing a certain degree of stain resistance to the substrate, such treatments tended to possess limited durability against laundering. In addition, such polymers inhibited the release of stains, especially in circumstances when the stains wet the substrate by force or were allowed to dry on the substrate. In fact, stain removal was more difficult under these circumstances than if no treatment was applied to the substrate.

In addition to fluoropolymers, silicones, waxes and various other compounds have been disclosed for imparting repellency to textiles and other substrates. With the exception of fluoropolymers, such compounds usually only provide water repellency and possess limited durability against laundering. These techniques are disclosed, for example, in U.S. Pat. No. 4,421,796 to Burril, et al.

U.S. Pat. No. 3,574,791 to Sherman, et al. and U.S. Pat. No. 3,896,088 to Raynolds, et al. disclose fluorinated oily stain release agents that impart some degree of water and oil repellency to a substrate without detrimentally impacting stain removal during laundering. Basically, these patents disclose polymers comprising both fluorinated, repellent moieties and hydrophilic moieties. It is claimed that such polymers exhibit a "flip-flop" mechanism that exposes the fluorinated segment in air to provide stain resistance and then exposes the hydrophilic segment in an aqueous environment to provide stain release. Such polymers typically exhibit lower repellency than traditional fluorochemicals, especially lower water repellency, and they also suffer from a lack of durability to laundering.

U.S. Pat. No. 4,624,676 to White, et al. discloses unique silicone compounds, such as organosiloxanes, that impart stain release properties to a substrate. Durability is claimed if these compounds are cross-linked. The compounds may self cross-link or can cross-link to the substrate, especially when appropriate catalysts are utilized. Such compounds may provide resistance to water based stains, but rarely to oil based stains.

U.S. Pat. No. 4,834,764 to Deiner, et al. discloses the use of cross-linking resins, such as methylol containing resins or blocked diisocyanates, to enhance the durability of fluoropolymers. Indeed, such resins increase the durability of fluoropolymers against laundering. These resins are added to the aqueous treatment containing the fluoropolymer. However, while indeed increasing the durability of the stain repellent properties, acceptable stain release does not result from this combination.

U.S. Pat. No. 4,540,765 to Koemm, et al. discloses fluorochemical repellents that possess greater durability to laundering than previous attempts have shown. Typically, such polymers contain, within the polymer, certain cross-linkable moieties. Examples of such cross-linkable moieties include methylol groups, blocked diisocyanate groups, epoxy groups, and the like. Such cross-linkable polymers indeed possess greater durability against laundering. As is the case with U.S. Pat. No. 4,834,764 to Deiner, durability is improved, but acceptable stain release is not observed.

U.S. Pat. No. RE 28,914 to Marco discloses the use of carboxylated acrylic stain release polymers, fluoropolymers, and aminoplast resins to produce a cellulose-containing textile that possesses good stain repellency and improved stain release. However, this treatment only works with cellulose-containing textile substrates, which excludes most synthetic fibers.

U.S. Pat. No. 4,695,488 to Hisamoto, et al. discloses a stain release composition comprising a polymer that contains fluoroalkyl groups and alkoxy groups, a hydrophilic resin, and optionally, a water and oil repellent. This composition is claimed to impart durable stainproofing and stain release properties to a substrate. However, the level of water and oil repellency disclosed is rather low, and the stainproofing test disclosed is more indicative of stain resistance than of stain release.

Even with so many attempts within this crowded field to provide the desired properties discussed above, there have been no wash-durable treatments imparting acceptable levels of simultaneous water repellency, oil repellency, and stain release characteristics to certain surfaces, in particular fabrics, and most notably, cotton-containing fabrics disclosed, utilized, or suggested within this industry. Thus, none of the above disclosed references adequately discloses a surface that possesses durably high levels of water and oil repellency and acceptable levels of stain release for and/or on a variety of substrates. Market and consumer demands have shown that it would be desirable to render various substrates resistant to staining by as many common staining materials as possible and simultaneously render the substrates with improved stain removal characteristics by using routine cleaning procedures appropriate for the substrates. These cleaning procedures may include washing, such as in a home or industrial laundering machine, or spot cleaning procedures, such as used for upholstery. In addition, various other routine cleaning procedures, such as those employed for carpet cleaning and dry cleaning, are contemplated. Thus, in spite of a longstanding need and consumer demand for substrates having durable repellency and stain release characteristics, prior attempts have fallen short of such a goal.

SUMMARY OF THE INVENTION

Therefore, it is one object of the current invention to provide novel compositions that impart wash-durable oil repellency, water repellency, stain resistance, and stain release properties simultaneously to a substrate. It is also an object of the current invention to disclose a substrate that exhibits durably high levels of water and oil repellency and acceptable levels of stain release during and after standard laundering procedure, such as home and industrial washing, dry cleaning, or other typical methods of surface and/or substrate cleaning. It is yet another object of the current invention to disclose a method of treating a substrate to obtain durably high levels of oil and water repellency and acceptable stain release properties. Other objects of this invention include, without limitation, application of such novel compositions to certain fabric substrates to impart such wash-durable properties thereto either through typical immersion, padding, exhaustion, or other like application procedures, or through in-home dryer application methods.

Accordingly, this invention encompasses a composition for altering the surface energy of a substrate in response to a change in the substrate's environment, said composition comprising: a high surface energy component, a low surface energy component, and a hydrophobic cross-linking component. More particularly, such an invention encompasses a composition for imparting durable repellency and stain release to a substrate, said composition comprising the resultant product of at least one hydrophilic stain release agent, at least one hydrophobic stain repellency agent cross-linked by at least one hydrophobic cross-linking agent. Further encompassed within this invention is a fabric surface treatment composition comprising at least one fluorinated polymer component, wherein said composition imparts certain repellency and stain release properties to test polyester or cotton fabric substrates in terms of wash-durable and high oil repellency ratings, water repellency ratings, spray ratings, and stain release ratings as discussed below. In such situations, it should be evident that the composition is thus defined in terms of the properties it imparts to such specific test fabrics, and thus the invention does not require such fabrics to be present as part of the inventive composition.

Other portions of this invention include specific fabric substrates, such as a fabric substrate comprised of at least 20% cotton fiber by weight of the total weight of said substrate, wherein said substrate exhibits an oil repellency rating of at least 4.0 when tested by AATCC Test Method 118-2000; a water repellency rating of at least 4.0 when tested by the 3M Water Repellency Test II (May, 1992); a spray rating of at least 70 when tested by AATCC Test Method 22-2000; and a stain release rating for corn oil and mineral oil of at least 4.0 when tested by AATCC Test Method 130-2000; wherein said properties are exhibited after said test fabric has been laundered and dried in accordance with AATCC Test Method 130-2000 after 20 washes. Alternatively, and also encompassed herein, is a fabric substrate comprised of at least 20% cotton fiber by weight of the total weight of said substrate, wherein said substrate exhibits a change in surface energy in response to a change in the substrate's environment to the extent that upon exposure to a temperature of about 25 degrees C. the measured surface energy is from less than about 20 millijoules per square meter, and upon exposure to a temperature of about 40 degrees C., the measured surface energy is greater than about 20 millijoules per square meter.

Other fabric substrates are provided as well within this invention, including, without limitation, though potentially preferred, a fabric substrate comprising polyester fibers, wherein said substrate exhibits an oil repellency rating of at least 3.0 when tested by AATCC Test Method 118-2000; a water repellency rating of at least 3.0 when tested by the 3M Water Repellency Test II (May, 1992); a spray rating of at least 50 when tested by AATCC Test Method 22-2000; and a stain release rating for corn oil and mineral oil of at least 3.5 when tested by AATCC Test Method 130-2000; wherein said properties are exhibited after said test fabric has been laundered and dried in accordance with AATCC Test Method 130-2000 after 20 washes, as well as exhibiting the same surface energy modification properties as presented above pertaining to cotton fiber fabrics.

Additionally encompassed within this invention is a method of imparting durable repellency and stain release to a substrate, the method comprising the steps of:

(a) providing a substrate;

(b) coating the substrate with a composition comprised of a hydrophilic stain release agent, a hydrophobic stain repellency agent, and a hydrophobic cross-linking agent;

(c) heating the substrate to remove substantially all of the excess liquid from the coated substrate; and (d) optionally, further heating the coated substrate.

Such inventive compositions, fabrics, and methods are discussed in greater detail below.

BRIEF DESCRIPTION OF THE DRAWINGS

FIG. 1 is a graphical representation of XPS Surface Chemical Analysis for a microdenier polyester textile substrate treated with the inventive chemical composition of the present invention and for several microdenier polyester textile substrates treated with various competitive chemical compositions. The graph shows surface chemical analysis of fluorine, carbon, and oxygen before the substrate is exposed to a change in its environment (i.e., as received following treatment with chemistry), after the substrate is exposed to a change in its environment (i.e., substrate was wetted with water for 1 hour at 40° C., then vacuum dried), and after the substrate has been heated again (150° C. for 5 minutes).

FIG. 2 is a graphical representation similar to FIG. 1, except that the graph shows surface chemical analysis of fluorine, carbon, and oxygen before the substrate is exposed to a change in its environment (i.e., "as received" following treatment with chemistry) and after the substrate has been washed and dried 10 times.

DETAILED DESCRIPTION OF THE INVENTION

Definitions

"Water repellency" and "oil repellency" are generally defined as the ability of a substrate to block water and oil from penetrating into the substrate, respectively. For example, the substrate may be a textile substrate which is capable of blocking water and oil from penetrating into the fibers of the textile substrate.

"Stain release" generally is defined as the degree to which a stained substrate approaches its original, unstained appearance as a result of a care procedure. As defined herein, high levels of stain resistance means an oil repellency rating of at least 3.0 when tested by AATCC Test Method 118-2000, a water repellency rating of at least 1.0 when tested by the 3M Water Repellency Test II (May, 1992), and a spray rating of at least 50 when tested by AATCC Test Method 22-2000. Acceptable stain release, as described herein, means a rating for corn oil and mineral oil release of at least 3.0 when tested by AATCC Test Method 130-2000.

"Wash durability" is generally defined as the ability of a substrate to retain an acceptable level of a desired function through a reasonable number of standard laundering cycles. More specifically, durability, as described herein, is intended to describe a substrate that maintains adequate properties of stain resistance, water repellency, oil repellency, and spray rating after a minimum of 10 wash cycles, more preferably after 20 wash cycles, and most preferably after 50 wash cycles, in accordance with AATCC Test Method 130-2000. This substrate may be a textile substrate, such as, for example, a polyester textile fabric.

The terms "fluorocarbons," "fluoropolymers," and "fluorochemicals" may be used interchangeably herein and each represents a polymeric material containing at least one fluorinated segment.

The term "padded" indicates that a liquid coating was applied to a substrate by passing the substrate through a bath and subsequently through squeeze rollers.

"Hydrophilic" is defined as having a strong affinity for or the ability to absorb water.

"Hydrophobic" is defined as lacking affinity for or the ability to absorb water.

"High surface energy" is defined as a surface energy equal to or greater than about 25 $mJ/m^2$ at about 25° C. as calculated from Fowkes two component approach to solid surface energy (for additional information on the Fowkes equation, see *Industrial and Engineering Chemistry,* 1964, Chapters 12, 40, and 56 by F. M. Fowkes).

"Low surface energy" is defined less than about 25 $mJ/m^2$ at about 25° C. as calculated from Fowkes two component approach to solid surface energy.

A high surface energy surface describes a surface, such as cotton, than can be spontaneously wet (<90° contact angles) by lower surface tension liquids, such as water.

A low surface energy surface, such as Teflon™, does not spontaneously wet with water and maintains >90° contact angles with liquids containing higher surface tensions (approximately, >25mN/m.)

Compositions:

The compositions useful for rendering a substrate with durable stain resistance and stain release are typically comprised of a hydrophilic stain release agent, a hydrophobic stain repellency agent, a hydrophobic cross-linking agent, and optionally, other additives to impart various desirable attributes to the substrate. Within the scope of this invention, new chemical compositions are contemplated wherein the relative amount and chain length of each of the aforementioned chemical agents may be optimized to achieve the desired level of performance for different target substrates within a single chemical composition.

Hydrophilic stain release agents may include ethoxylated polyesters, sulfonated polyesters, ethoxylated nylons, carboxylated acrylics, cellulose ethers or esters, hydrolyzed polymaleic anhydride polymers, polyvinylalcohol polymers, polyacrylamide polymers, hydrophilic fluorinated stain release polymers, ethoxylated silicone polymers, polyoxyethylene polymers, polyoxyethylene-polyoxypropylene copolymers, and the like, or combinations thereof. Hydrophilic fluorinated stain release polymers may be preferred stain release agents. Potentially preferred, non-limiting, compounds of this type include UNIDYNE® TG-992, available from Daikin Corp., REPEARL® SR1100, available from Mitsubishi Corp., as well as ZONYL® 7910, available from DuPont. Treatment of a substrate with a hydrophilic stain release agent generally results in a surface that exhibits a high surface energy.

Hydrophobic stain repellency agents include waxes, silicones, certain hydrophobic resins, fluoropolymers, and the like, or combinations thereof. Fluoropolymers may be preferred stain repellency agents. Potentially preferred, non-limiting, compounds of this type include REPEARL® F8025 and REPEARL® F-89, both available from Mitsubishi Corp., as well as ZONYL® 7713, available from DuPont. Treatment of a substrate with a hydrophobic stain repellency agent generally results in a surface that exhibits a low surface energy.

Hydrophobic cross-linking agents include those cross-linking agents which are insoluble in water. More specifically, hydrophobic cross-linking agents may include monomers containing blocked isocyanates (such as blocked diisocyanates), polymers containing blocked isocyanates (such as blocked diisocyanates), epoxy containing compounds, and the like, or combinations thereof. Diisocyanate containing monomers or diisocyanate containing polymers may be the preferred cross-linking agents. However, monomers or polymers containing two or more blocked isocyanate compounds may be the most preferred cross-linking agents. One potentially preferred cross-linking agent is REPEARL® MF, also available from Mitsubishi Corp. Others include ARKOPHOB® DAN, available from Clariant, EPI-REZ® 5003 W55, available from Shell, and HYDROPHOBOL® XAN, available from DuPont.

The total amount of the chemical composition applied to a substrate, as well as the proportions of each of the chemical agents comprising the chemical composition, may vary over a wide range. The total amount of chemical composition applied to a substrate will depend generally on the composition of the substrate, the level of durability required for a given end-use application, and the cost of the chemical composition. As a general guideline, the total amount of chemical solids applied to the substrate will be found in the range of about 0.25% to about 10.0% on weight of the substrate. More preferably, the total amount of chemical solids applied to the substrate may be found in the range of about 0.5% to about 5.0% on weight of the substrate. Typical solids proportions and concentration ratios of stain repellency agent to stain release agent to cross-linking agent may be found in the range of about 10:1:0.1 and about 1:10:5, including all proportions and ratios that may be found within this range. Preferably, solids proportions and concentration ratios of stain repellency agent to stain release agent to cross-linking agent may be found in the range of about 5:1:0.1 and about 1:5:2. Most preferably, solids proportions and concentration ratios of stain repellency agent to stain release agent to cross-linking agent may be 1:2:1.

The proportion of stain release agent to stain repellency agent to cross-linking agent may likewise be varied based on the relative importance of each property being modified. For example, higher levels of repellency may be required for a given end-use application. As a result, the amount of repellency agent, relative to the amount of stain release agent, may be increased. Alternatively, higher levels of stain release may be deemed more important than high levels of stain repellency. In this instance, the amount of stain release agent may be increased, relative to the amount of stain repellency agent.

For the purpose of producing a more economical chemical composition, the type of stain release agent, stain repellency agent, and cross-linking agent may be varied based on the end-use of the substrate treated with the chemical composition. For example, a treated substrate may be produced that is not expected to encounter oil based stains. Accordingly, more economical repellency agents, such as silicones, may be utilized as one component of the chemical composition.

The substrate of the current invention may include glass, fiberglass, metal, films, paper, plastic, stone, brick, textiles, or combinations thereof. Glass, such as windows of buildings or automobiles may benefit from the current invention. In addition metal articles, such as bridges or automobile bodies may benefit from the current invention. Such items could resist staining by common soils and be cleaned by rain or the like. Films may include thermoplastic material, thermoset materials, or combinations thereof. Suitable thermoplastic or thermoset materials include polyolefin, polyester, polyamide, polyurethane, acrylic, silicone, melamine compounds, polyvinyl acetate, polyvinyl alcohol, nitrile rubber, ionomers, polyvinyl chloride, polyvinylidene chloride, chloroisoprene, or combinations thereof. The polyolefin may be polyethylene, polypropylene, ethylvinyl acetate, ethylmethyl acetate, or combinations thereof.

Textile substrates comprise one potentially preferred, non-limiting embodiment of the current invention. The textile substrates may be of any known construction including a knit construction, a woven construction, a nonwoven construction, and the like, or combinations thereof. Textile substrates may have a fabric weight of between about 1 and about 55 ounces/yard$^2$, and more preferably between about 2 and about 12 ounces/yard$^2$.

The material of the textile substrate can be synthetic fiber, natural fiber, man-made fiber using natural constituents, inorganic fiber, glass fiber, or a blend of any of the foregoing. By way of example only, synthetic fibers may include polyester, acrylic, polyamide, polyolefin, polyaramid, polyurethane, or blends thereof. More specifically, polyester may include polyethylene terephthalate, polytrimethylene terephthalate, polybutylene terephthalate, polylactic acid, or combinations thereof. Polyamide may include nylon 6, nylon 6,6, or combinations thereof. Polyolefin may include polypropylene, polyethylene, or combinations thereof. Polyaramid may include poly-p-phenyleneteraphthalamide (i.e., Kevlar®), poly-m-phenyleneteraphthalamide (i.e., Nomex®), or combinations thereof. Exemplary natural fibers include wool, cotton, linen, ramie, jute, flax, silk, hemp, or blends thereof. Exemplary man-made materials using natural constituents include regenerated cellulose (i.e., rayon), lyocell, or blends thereof.

The textile substrate may be formed from staple fiber, filament fiber, slit film fiber, or combinations thereof. The fiber may be exposed to one or more texturing processes. The fiber may then be spun or otherwise combined into yarns, for example, by ring spinning, open-end spinning, air jet spinning, vortex spinning, or combinations thereof. Accordingly, the textile substrate will generally be comprised of interlaced fibers, interlaced yarns, loops, or combinations thereof.

The textile substrate may be comprised of fibers or yarns of any size, including microdenier fibers or yarns (fibers or yarns having less than one denier per filament). The fibers or yarns may have deniers that range from less than about 1 denier per filament to about 2000 denier per filament or, more preferably, from less than about 1 denier per filament to about 500 denier per filament.

Furthermore, the textile substrate may be partially or wholly comprised of multi-component or bi-component fibers or yarns in various configurations such as, for example, islands-in-the-sea, core and sheath, side-by-side, or pie configurations. Depending on the configuration of the bi-component or multi-component fibers or yarns, the fibers or yarns may be splittable along their length by chemical or mechanical action.

The textile substrate may be printed or dyed, for example, to create aesthetically pleasing decorative designs on the substrate or to print informational messages on the substrate. The textile substrate may be colored by a variety of dyeing and/or printing techniques, such as high temperature jet dyeing with disperse dyes, thermosol dyeing, pad dyeing, transfer printing, screen printing, digital printing, ink jet printing, flexographic printing, or any other technique that is common in the art for comparable, equivalent, traditional textile products. In addition, the fibers or yarns comprising the textile substrate of the current invention may be dyed by suitable methods prior to substrate formation, such as for instance, via package dyeing, solution dyeing, or beam dyeing, or they may be left undyed. In one embodiment, the textile substrate may be printed with solvent-based dyes rather than water based dyes. Solvent-based dyes may be more likely to uniformly wet the hydrophobic surfaces of the current invention.

It is also contemplated that a textile substrate composite material may be formed by combining one or more layers of textile substrate together. For example, it may be desirable to combine several layers of an open weave textile substrate together to form a textile substrate composite material. The composite material may also include adhesive material or one or more layers of film. The composite material may then be treated with the chemical composition of the present invention to achieve a material that exhibits durable stain repellency and stain release performance characteristics. Alternatively, in yet another embodiment of the invention, the textile substrates comprising the composite material may be treated with the chemical composition before being combined into a composite material.

In one potentially preferred embodiment of the current invention, a commodity item with a limited useful life may be treated with the minimum amount of chemical to achieve the required properties. More specifically, a substrate, such as a lightweight polyester disposable lab coat, may have only about 0.25% to about 1.5% of the chemical solids applied to the substrate. Conversely, in another potentially preferred embodiment of the invention, a premium item with a longer useful life may be treated with a near maximum amount of chemical to achieve the desired level of durability. More specifically, a substrate, such as a premium cotton apparel item or a polyester/cotton blend workwear uniform, may have about 1.0% to about 10.0% of the chemical solids applied to the substrate.

Application of the stain release, stain repellent, and cross-linking agents to the textile substrate may be accomplished by a variety of application methods which include immersion coating, padding, spraying, foam coating, exhaustion techniques, or by any other technique whereby one can apply a controlled amount of a liquid suspension to a textile substrate. Employing one or more of these application techniques may allow the chemical to be applied to the textile substrate in a uniform manner.

The chemical agents may be applied simultaneously or sequentially to the textile substrate. For example, a stain release agent, stain repellency agent, and a hydrophobic cross-linking agent may be mixed together in one solution and then simultaneously applied to the textile substrate by padding. After application of the chemical agents to the textile substrate, the treated substrate is generally exposed to a drying step to evaporate excess liquid, leaving the solid active components on the surface of the treated substrate. Drying can be accomplished by any technique typically used in manufacturing operations, such as dry heat from a tenter frame, microwave energy, infrared heating, steam, superheated steam, autoclaving, or the like, or any combination thereof. In yet another embodiment, a stain release agent may be applied to the textile substrate, the substrate may be dried or left wet, and then a stain repellency agent and hydrophobic cross-linking agent may be applied on top of the stain release-agent, creating a layered, sequential chemical treatment on the surface of the textile substrate.

It may be desirable to expose the treated substrate to an additional heating step to further enhance the performance or durability of the chemical agents. This step may be referred to as a curing step. By way of example, additional heating may (a) enable discreet particles of the active components of the chemical agents to melt-flow together, resulting in uniform, cohesive film layers; (b) induce preferred alignment of certain segments of the chemical agents; (c) induce cross-linking reactions between the chemical agents or between the chemical agents and the substrate; or (d) combinations thereof.

In many instances, for a textile substrate to perform satisfactorily, regardless of its end-use application, attributes other than durable stain resistance and stain release are desirable. Examples of such attributes include static protection, wrinkle resistance, shrinkage reduction or elimination, desirable hand (or feel) requirements, dyefastness requirements, odor control, flammability requirements, resistance to dry soiling, and the like. Unexpectedly, a textile substrate treated according to the present invention actually exhibits anti-cling and anti-static properties, which is a desirable feature of the substrate, for instance, during a garment cutting and sewing process.

Accordingly, it may be desirable to treat the textile substrate with finishes containing chemicals such as antimicrobial agents, antibacterial agents, antifungal agents, flame retardants, UV inhibitors, antioxidants, coloring agents, lubricants, antistatic agents, fragrances, and the like, or combinations thereof. Chemical application may be accomplished by immersion coating, padding, spraying, foam coating, or by any other technique whereby one can apply a controlled amount of a liquid suspension to a textile substrate. Employing one or more of these application techniques may allow the chemical to be applied to the textile substrate in a uniform manner. Many such chemical treatments can be incorporated simultaneously with the chemical composition of the current invention, or such treatments may be carried out prior to treatment with the chemical composition of the current invention. It is also possible, using appropriate techniques, to apply many such chemical treatments after treatment with the chemical composition of the current invention.

Additionally, the textile substrate may also be treated by mechanical finishing techniques. For example, it may be desirable to expose the textile substrate to mechanical treatment such as calendering, embossing, etching, rainbow or hologram embossing, film or metal foil hologram embossing, fabric metallization, heat setting, hydroentanglement with water or air, sanforizing, glazing, schreinering, sueding, sanding, emorizing, napping, shearing, tigering, decating, fabric patterning through the use of water, air, laser, or patterned rolls, and the like, or combinations thereof. These mechanical treatments typically provide desirable effects to the textile substrate which affect such properties as the appearance, strength, and/or hand of the fabric. Depending on which mechanical treatment is utilized, advantages may be obtained by treatment either before or after the chemistry of the current invention is applied. By way of example, benefits from sanding prior to chemical treatment and calendaring after chemical treatment may be envisioned.

Within the scope of the current invention, it is also contemplated that asymmetric textile substrates may be created with surfaces having dual, functional attributes. For example, a textile substrate, having a first and a second surface, may be produced that possesses a first hydrophobic surface and a second hydrophilic surface. Such a dual functional textile substrate may be made, for example, by coating both surfaces of the textile substrate with a hydrophilic stain release agent and then coating the first surface of the substrate with a hydrophobic stain repellent agent and a hydrophobic cross-linking agent. Chemical application methods include any of those previously discussed, such as spray coating, foam coating, and the like. As a result, garments made in this manner may provide increased protection from environmental or chemical assault by repelling liquids on the first surface of the garment and, at the same time, provide increased user comfort by absorbing moisture, such as perspiration, on the second surface of the garment.

DESCRIPTION OF THE PREFERRED EMBODIMENT

Treatment Compositions and Applications Thereof to Fabric Substrates

A) Fabric Application Procedures:

All examples provided below were treated according to one of the following procedures and are noted accordingly.

I) One Step Application Procedure:

1. An approximately 14 inch by 18 inch piece of fabric was immersed into a bath containing the chemical composition comprised of the desired chemical agents.
2. Unless otherwise stated, all chemical percents (%) were % by weight based on the total weight of the bath prepared, and the balance remaining when chemical percents or grams of chemical are given is comprised of water. In addition, the % chemical was based on the chemical as received from the manufacturer, such that if the composition contained 30% active component, then X % of this 30% composition was used.
3. After the fabric was completely wet, the fabric was removed from the treatment bath and run between squeeze rolls at about 40 psi to obtain a uniform pickup generally between about 50 and about 90%.
4. The fabric was pulled taught and pinned to a frame to retain the desired dimensions.
5. The pin frame was placed into a Despatch oven at a temperature of between about 300 and about 400 degrees F. for between about 0.5 and about 5 minutes to dry and heatset the fabric and to cure the finish.
6. Once removed from the oven, the fabric was removed from the pin frame and allowed to equilibrate at room temperature prior to testing.

II) Two Step Application Procedure:

1. The one step application procedure was repeated, except that rather than adding all the chemical agents to one chemical bath, one or more chemical agents comprising the chemical composition were separately applied to the fabric in a specified order as described below.
2. The fabric was immersed into a bath containing one or more of the chemical agents comprising the chemical composition.
3. After the fabric was completely wet, the fabric was removed from the bath and run between squeeze rollers as described in the one step application procedure.
4. The fabric was dried at approximately 300 degrees F. for about 5 minutes in a Despatch oven.
5. The fabric was then immersed into a fresh bath containing the remaining desired chemical agents comprising the chemical composition.
6. The fabric was then dried and cured as described in the one step application procedure.

III) Alternative Two Step Application Procedure:

1. Approximately 100 grams of fabric were placed into a Werner-Mathis laboratory dyeing machine.
2. Approximately 2 liters of water containing the desired chemicals were added to a jet dyeing machine.
3. The dyeing machine was closed, heated to about 130 degrees C., and held at this temperature for about 30 minutes. The pressure increased, as the water heated, to approximately 3 bars.
4. The dyeing machine was cooled to about 70 degrees C., and the treatment bath was drained.
5. The fabric was centrifuged in the dyeing machine to remove excess liquor.
6. While still wet, the fabric was immersed into a treatment bath containing the desired chemical agents. Typically, the fabric was immersed for about 1 to about 10 seconds.
7. Once removed from this bath, the fabric was squeezed through pad rolls, placed onto a pin frame and dried and cured as in the one step application procedure described previously.

IV) Postcure Application Procedure:

1. The one step application procedure was repeated, except rather than curing the hydrophobic cross-linking agent during one drying step, the fabric was dried and the chemical agents were cured as follows:
   (a) the fabric was cured at the first stage at 300 degrees F. for about 5 minutes in a Despatch oven;
   (b) the fabric was then exposed to steam in a hot head press set at 320 degrees F. as follows:
      i) 5 seconds at high pressure
      ii) 10 seconds head steam
      iii) 5 seconds buck steam
      iv) 5 seconds buck vacuum; and
   (c) the fabric was then cured at 310 degrees F. for 10 minutes (to simulate the process at garment manufacturers to cure the permanent press post-cure resin).

V) Home Dryer Application Procedure:

1. An 8 inch by 9 inch piece of fabric was cut for the procedure, and a 4.5 inch by 6 inch template was made and placed on top of the fabric.
2. A chemical composition was placed in a spray bottle and 2.5 grams of the solution was sprayed on the fabric through the template opening.
3. The treated fabric was placed in a Dryel® home dry cleaning bag obtained from a Dryel® home dry cleaning kit and put in a home dryer for about 30 minutes at high setting.
4. The fabric sample was removed from the dryer and conditioned at room temperature for between about 15 and about 45 minutes before testing.

B) Treatment Compositions Utilized Herein

Example 1

A 200 gram bath containing the following chemicals was prepared:

1. 9 grams Unidyne TG-992, a fluorinated hydrophilic stain release agent available from Daikin Corp;
2. 3 grams Repearl F8025, a fluorinated stain repellent agent available from Mitsubishi Corp.; and
3. 3.6 grams Repearl MF, a hydrophobic blocked diisocyanate cross-linking agent available from Mitsubishi Corp.

A 100% microdenier polyester fabric was treated with this chemical composition according to the one step application procedure described previously. The wet pickup of the chemical composition on the fabric was about 60%.

The polyester fabric was obtained from Milliken & Company of Spartanburg, S.C. The fabric was comprised of textured filament polyester 1/140/200 denier warp yarns and textured filament polyester 1/150/100 denier fill yarns woven together in a 2 by 2 right hand twill pattern having 175 warp yarns and 80 fill yarns per inch of fabric (hereinafter referred to as "a test polyester fabric" specifically for this invention). The fabric was exposed to a face finishing process, which involved gently sanding the surface of the fabric, and subsequently jet dyed. The finished fabric had a weight of about 6 ounces per square yard.

The treated fabric was tested for water and oil repellency, spray rating, and corn oil and mineral oil stain release by the methods described previously after 0 home washes ("AR" indicates "as received"), 10 home washes, 20 home washes, 30 home washes, 40 home washes, and 50 home washes. Test results are shown in Table IA.

Example 2

Example 1 was repeated, except the concentrations of the chemical agents were varied as follows:

| | |
|---|---|
| Example 2A: | 8.0 grams Unidyne TG-992, 2.4 grams Repearl F8025, 3.0 grams Repearl MF; |
| Example 2B: | 4.0 grams Unidyne TG-992, 6 grams Repearl F8025, 3.0 grams Repearl MF; and |
| Example 2C: | 2.0 grams Unidyne TG-992, 6 grams Repearl F8025, 3.0 grams Repearl MF. |

Test results are shown in Table IA.

Example 3

Comparatives

Example 1 was repeated, except that one chemical agent of the chemical composition was eliminated from the bath as follows:

| | |
|---|---|
| Example 3A: | No Unidyne TG-992 was used; |
| Example 3B: | No Repearl F8025 was used; and |
| Example 3C: | No Repearl MF was used. |

Test results are shown in Table IA.

Example 4

Example 1 was repeated, except that some of the chemical agents of the chemical composition were replaced with alternative chemicals available from various manufacturers as follows:

| | |
|---|---|
| Example 4A: | Repearl F8025 was replaced with 1% Unidyne TG-571 available from Daikin Corp; |
| Example 4B: | Repearl F8025 was replaced with 2% Zonyl 7713 available from DuPont; and |
| Example 4C: | Repearl F8025 was replaced with 3% Zonyl 7713 and 4.5% Unidyne TG-992 was replaced with 1% Zonyl 7910 available from DuPont. |

The wet pickup of the chemical composition on the fabric was about 60%. Test results are shown in Table IA.

Example 5

Two polyester fabrics, useful for bedspreads, were made by Milliken & Company and treated with the following chemistry according to the one step application procedure described previously:

1. 4.5% Unidyne TG-992;
2. 1% Repearl F8025; and
3. 1.8% Arkophob DAN (a hydrophobic cross-linking agent available from Clariant).

The wet pickup of the chemical composition on the fabric was about 75%.

Example 5A included treatment of one polyester bedspread fabric having a linen weave and comprised of flat spun polyester 56T DB 1/200/136 denier warp yarns available from DuPont and flat spun polyester 56T DB 2/150/68 denier fill yarns available from DuPont. The fabric was further comprised of 61 warp ends per inch of fabric and 45 fill yarns per inch of fabric and had a final fabric weight of about 8.75 ounces/square yard.

Example 5B was the same as Example 5A, except that the polyester bedspread fabric was treated with the inventive chemistry and then transfer printed.

Example 5C included treatment of a second polyester bedspread fabric having a faille weave and comprised of flat spun polyester fb3 SDY 75/36 denier warp yarns available from Nanya and flat spun polyester T-121 8/1 denier fill yarns available from DuPont. The fabric was further comprised of 164 warp ends per inch of fabric and 37 fill yarns per inch of fabric and had a final fabric weight of about 10.5 ounces/square yard.

Example 5D was the same as Example 5C, except that the polyester bedspread fabric was treated with the inventive chemistry and then transfer printed.

The treated fabrics were tested for water and oil repellency, spray rating, and corn oil and mineral oil stain release by the methods described previously after 0 industrial washes ("AR" indicates "as received") and 5 industrial washes. Test results are shown in Table IB.

Example 6

Comparatives

Example 1 was repeated, except that each chemical agent of the chemical composition was replaced with various competitive stain release and/or stain repellent chemicals. Examples G and H were purchased garments (pants) which were tested along with the treated fabrics below. The chemicals used are as follows:

| | |
|---|---|
| Example 6A: | 5.0% Scotchgard FC-5102 (stain repellent available from 3M) |
| Example 6B: | 5.0% Zonyl 7040 (stain repellent available from DuPont) |
| Example 6C: | 8.0% Scotchgard L-18542 (stain repellent available from 3M) |
| Example 6D: | 5.0% Scotchgard FC-248 (fluorinated stain release agent available from 3M) |
| Example 6E: | 5.0% Zonyl 7910 (fluorinated stain release agent available from DuPont) |
| Example 6F: | 5.0% Scotchgard L-18369 (PM 490) (fluorinated stain release agent available from 3M) |
| Example 6G: | Stain Defender Pants (DuPont Teflon ™ on polyester/cotton blend garment) |
| Example 6H: | NanoCare Pants (100% Cotton believed to be treated according to U.S. Pat. No. 6,379,753 assigned to Nanotex.) |
| Example 6I: | 2.5% Unidyne TG-992<br>0.5% Reactant 901<br>0.25% Zinc nitrate hydrate<br>0.35% Unidyne TG-571 (Example 11 in U.S. Pat. No. 4,695,488 to Daikin) |
| Example 6J: | 3.0% Repearl F8025<br>2.0% Repearl SR-1100 (stain release agent available from Mitsubishi Corp.) |

Test results are shown in Table II.

Example 7

Comparatives

Example 1 was repeated, except that the polyester fabric was treated in accordance with the two-step application procedure described previously. In the first step of the procedure, 6.0 grams of PD-75, a carboxylated acrylic stain release agent available from Milliken & Company, and 0.5 grams of calcium acetate were applied to the fabric. In the second application step of the procedure, 6 grams of Repearl F8025, a fluorinated stain repellent agent, and 3.0 grams of Repearl MF were applied to the fabric.

The treated fabrics were tested for water and oil repellency, spray rating and corn oil and mineral oil stain release by the methods described previously after 0 home washes ("AR" indicates "As Received"), 5 home washes, and 30 home washes. Test results are shown in Table III.

Example 8

Example 1 was repeated, except that the polyester fabric was treated in accordance with the alternative two step application procedure described previously. In the first step of the procedure, 2% Unidyne TG-992 on weight of the fabric and 1.0% acetic acid on weight of fabric were applied to the fabric in the dyeing machine. In the second step of the procedure, 8.0% Repearl F8025 and 9.6% Repearl MF were subsequently applied to the fabric.

The treated fabrics were tested for water and oil repellency, spray rating and corn oil and mineral oil stain release by the methods described previously after 0 home washes ("AR" indicates "As Received"), 5 home washes, and 30 home washes. Test results are shown in Table 11.

Example 9

A 200-gram bath containing the following chemicals was made:

a. 12 grams Unidyne TG-992;
b. 4 grams Repearl F8025;
c. 4 grams Repearl MF;
d. 16 grams Freerez PFK, a permanent press resin available from Noveon, Inc.;
e. 4 grams Catalyst 531, a catalyst available from Omnova Solutions; and
f. 4 grams Atebin 1062, a softener available from Boehme Filatex.

A 100% cotton fabric was treated with this chemical composition according to the one step application procedure described above. The wet pickup of the chemical composition on the fabric was about 60%.

The fabric was obtained from Milliken & Company of Spartanburg, S.C. The fabric was comprised of 20/1 denier ring spun warp yarns and 11/1 denier open end spun fill yarns woven together in a 3 by 1 left hand twill pattern having 118 warp yarns and 54 fill yarns per inch of fabric. The fabric was subsequently dyed via a continuous dyeing process, sanforized, and then treated with the chemical composition. The finished fabric had a weight of about 8 ounces per square yard (hereinafter referred to as "a test cotton fabric" specifically for this invention).

The treated fabric was tested for water and oil repellency, spray rating, and corn oil and mineral oil stain release by the methods described previously after 0 home washes ("AR" indicates "as received"), 10 home washes, 20 home washes, and 30 home washes. Test results are shown in Table IV.

Example 10

Example 9 was repeated, except Repearl F8025 was substituted with Zonyl 7713 and Repearl MF was substituted with Hydrophobol XAN with concentrations varied as follows:

| | |
|---|---|
| Example 10A: | 8.0 grams Unidyne TG-992<br>4.0 grams Zonyl 7713<br>4.0 grams Hydrophobol XAN (a hydrophobic cross-linking agent available from DuPont); |
| Example 10B: | 6.0 grams Unidyne TG-992<br>6.0 grams Zonyl 7713<br>4.0 grams Hydrophobol XAN; and |
| Example 10C: | 4.0 grams Unidyne TG-992<br>8.0 grams Zonyl 7713<br>4.0 grams Hydrophobol XAN. |

Test results are shown in Table IV.

Example 11

Comparatives

Example 9 was repeated, except that one chemical agent of the chemical composition was eliminated from the bath as follows:

| | |
|---|---|
| Example 11A: | No Unidyne TG-992 was used; |
| Example 11B: | No stain repellent was used; and |
| Example 11C: | No hydrophobic cross-linker was used. |

Test results are shown in Table IV.

Example 12

Comparatives

Example 9 was repeated, except that each chemical agent of the chemical composition was replaced with various competitive stain release and/or stain repellent chemicals. (These are the same chemicals and chemical amounts used in Example 6). Examples G and H were purchased garments (pants) which were tested with the others shown below. The chemicals used are as follows:

| | |
|---|---|
| Example 12A: | 5.0% Scotchgard FC-5102; |
| Example 12B: | 5.0% Zonyl 7040; |
| Example 12C: | 8.0% Scotchgard L-18542; |
| Example 12D: | 5.0% Scotchgard FC-248; |
| Example 12E: | 5.0% Zonyl 7910; |
| Example 12F: | 5.0% Scotchgard L-18369 (PM 490); |
| Example 12G: | Stain Defender Pants (DuPont Teflon ™ on polyester/cotton blend pants); |
| Example 12H: | NanoCare Pants (100% cotton believed to be treated according to U.S. Pat. No. 6,379,753 assigned to Nanotex.); |
| Example 12I: | 2.5% Unidyne TG-992<br>0.5% Reactant 901<br>0.25% Zinc nitrate hydrate<br>0.35% Unidyne TG-571 (Example 11 in U.S. Pat. No. 4,695,488 to Daikin) |
| Example 12J: | 3.0% Repearl F8025<br>2.0% Repearl SR-1100 |

Test results are shown in Table V.

Example 13

A polyester and cotton blended fabric was treated with the inventive chemistry of the current invention according to the one step application procedure and postcure application procedures described previously. The fabric was obtained from Milliken & Company of Spartanburg, S.C. The fabric was comprised of approximately 65% polyester yarn and approximately 35% cotton yarn. The warp yarns were comprised of 14.0/1 open end spun 65/35 polyester/cotton staple fibers with 3.30 twist multiple. The fill yarns were comprised of 12.0/1 open end spun 65/35 polyester/cotton staple fibers with 3.25 twist multiple. The polyester staple fibers for both the warp and fill yarns had a denier of approximately 1.2. The warp and fill yarns were woven together in a 3 by 1 left hand twill pattern having 100 warp yarns and 47 fill yarns per inch of fabric. The fabric was subsequently dyed via a continuous dyeing process and treated with the inventive chemistry. The finished fabric had a weight of about 8.5 ounces per square yard.

The inventive chemistry included the following formulations:

| | |
|---|---|
| Example 13A: | processed using one step application procedure<br>3.75% Unidyne TG-992<br>1.25% Zonyl 7713 (a repellent available from DuPont)<br>1.25% Arkophob DAN<br>10% Permafresh MFX (a permanent press resin available from Omnova)<br>2.5% Catalyst KR (a catalyst available from Omnova)<br>0.25% Tebefoam (a defoamer available from Boehme Filatex)<br>0.5% Mykon XLT (a softener available from Omnova) |

-continued

| | |
|---|---|
| Example 13B: | processed using one step application procedure<br>5.4% Unidyne TG-992<br>1.75% Zonyl 7713<br>2% Arkophob DAN<br>10% Permafresh MFX<br>2.5% Catalyst KR<br>0.25% Tebefoam<br>0.5% Mykon XLT |
| Example 13C: | processed using one step application procedure<br>0.32% Unidyne TG-992<br>1.76% Arkophob DAN<br>3.87% Zonyl 7910<br>1.55% Repearl F8025<br>10% Permafresh MFX<br>2.5% Catalyst KR<br>0.25% Tebefoam<br>0.5% Mykon XLT |
| Example 13D: | processed using one step application procedure<br>5% Unidyne TG-992<br>1% Repearl F-89<br>3% Epi-Rez 5003 W55 (a hydrophobic cross-linking agent available from Shell) |
| Example 13E: | processed using one step application procedure<br>5% Unidyne TG-992<br>1% Repearl F-89<br>2% Witcobond W-293 (a hydrophobic cross-linking agent available from Crompton) |
| Example 13F: | processed using postcure application procedure;<br>5% Unidyne TG-992<br>1% Repearl F-89<br>3% Epi-Rez 5003 W55<br>5% Permafresh MFX<br>1.25% Catalyst KR<br>0.25% Tebefoam<br>0.5% Mykon XLT |
| Example 13G: | processed using postcure application procedure;<br>5% Unidyne TG-992<br>1% Repearl F-89<br>2% Witcobond W-293<br>5% Permafresh MFX<br>1.25% Catalyst KR<br>0.25% Tebefoam<br>0.5% Mykon XLT |
| Example 13H: | same as 13F, plus the addition of:<br>1% Pluronic F-68 (a stain release agent available from BASF) |
| Example 13I: | same as Example 13G, plus the addition of:<br>1% Pluronic F-68 |

Example 13F included the same chemical composition used in Example 13D, except that the permanent press resin was used along with other auxiliaries, and the composition was not fully cured to allow permanent creases to be introduced into the fabric. This is known in the art as postcure resin treatment. However, the fabric was fully cured to simulate treatment at garment manufacturing facilities before testing. Similarly, Example 13G included the same chemical composition used in Example 13E, except that the permanent press resin was added with other auxiliaries, and the composition was not fully cured to allow permanent creases to be introduced into the garment using the postcure resin treatment. The fabric was fully cured before testing.

Example 13H includes the same chemicals composition used in 13F, with the addition of a polyoxyethylene-polyoxypropylene copolymer (Pluronic F-68 from BASF). It was applied with the post cure application method. Example 13I includes the same chemicals composition used in 13F, with the addition of a polyoxyethylene-polyoxypropylene copolymer (Pluronic F-68 from BASF). It was also applied with the post cure application method.

The treated fabrics were tested for water and oil repellency, spray rating and corn oil and mineral oil stain release by the methods described previously after 0 home washes ("AR"

indicates "As Received"), 5 home washes, 10 home washes, 20 home washes, and 30 home washes. Test results are shown in Table VI.

Example 14

Comparatives

Example 13 was repeated, except that each chemical agent of the chemical composition was replaced with various competitive stain release and/or stain repellent chemicals. Additionally, the fabric used for Example 14D was of slightly different construction than the fabric described in Example 13. The fabric of 14D was also a 65/35 polyester/cotton blend fabric. However, the warp yarns were comprised of 16/1 open end spun 65/35 polyester/cotton staple fibers with 3.30 twist multiple. The fill yarns were comprised of 12.0/1 open end spun 65/35 polyester/cotton staple fibers. The polyester staple fibers for both the warp and fill yarns had a denier of approximately 1.2. The warp and fill yarns were woven together in a 2 by 1 left hand twill pattern having 88 warp yarns and 46 fill yarns per inch of fabric. The fabric was subsequently dyed via a continuous dyeing process and treated with the inventive chemistry. The finished fabric had a weight of about 7.2 ounces per square yard.

The chemical compositions are as follows:

| | |
|---|---|
| Example 14A: | processed using one step application procedure<br>1.5% Zonyl 7910<br>18% Permafresh MFX<br>4.5% Catalyst KR<br>1.25% Mykon XLT<br>0.5% Tebefoam 1868<br>0.35% Progapol DAP-9 |
| Example 14B: | processed using one step application procedure<br>11.1% Scotchgard L-18369<br>2.2% Hydrophobol XAN<br>9% Permafresh MFX<br>2.2% Catalyst 531<br>1% Mykon NRW3 |
| Example 14C: | processed using one step application procedure<br>6% Zonyl 7713<br>6% Zonyl 7714<br>2% Hipochem CSA<br>3% Ultratex REP<br>1.5% Hydrophobol XAN<br>13% Freerez PFK<br>2.9% Catalyst KR |
| Example 14D: | processed using one step application procedure<br>10% Zonyl S410<br>1% Atebin 1062<br>3% Ultratex REP<br>1% Hydrophobol XAN<br>15% Permafresh MFX<br>3.75% Catalyst 531 |
| Example 14E: | Stain Defender Pants (DuPont Teflon ™ on polyester/cotton blend pants); |
| Example 14F: | NanoCare Pants (100% cotton believed to be treated according to U.S. Pat. No. 6,379,753 assigned to Nanotex.); |
| Example 14G: | processed using postcure application procedure<br>8% Scotchgard L-18542<br>10% Permafresh MFX<br>2.5% Catalyst KR<br>0.25% Tebefoam<br>0.5% Mykon XLT |
| Example 14H: | processed using postcure application procedure<br>4% Scotchgard L-18542<br>10% Permafresh MFX<br>2.5% Catalyst KR<br>0.25% Tebefoam<br>0.5% Mykon XLT |

Test results are shown in Table VII.

Example 15

The fabric of Example 13 was treated using the following inventive chemical compositions:

| | |
|---|---|
| Example 15A: | processed using the one step application procedure<br>3.75% Unidyne TG-992<br>1.25% Zonyl 7713<br>1.25% Arkophob DAN<br>10% Permafresh MFX<br>2.5% Catalyst KR<br>0.25% Tebefoam<br>0.5% Mykon XLT |
| Example 15B: | processed using the one step application procedure<br>5.4% Unidyne TG-992<br>1.75% Zonyl 7713<br>2% Arkophob DAN<br>10% Permafresh MFX<br>2.5% Catalyst KR<br>0.25% Tebefoam<br>0.5% Mykon XLT |
| Example 15C: | processed using postcure application procedure<br>0.32% Unidyne TG-992<br>1.76% Arkophob DAN<br>3.87% Zonyl 7910<br>1.55% Repearl F8025<br>10% Permafresh MFX<br>2.5% Catalyst KR<br>0.25% Tebefoam<br>0.5% Mykon XLT |
| Example 15D: | processed using postcure application procedure<br>5% Unidyne TG-992<br>1% Repearl F-89<br>3% Epi-Rez 5003 W55 |
| Example 15E: | processed using postcure application procedure<br>5% Unidyne TG-992;<br>1% Repearl F-89;<br>0.5% Epi-Rez 5003 W55;<br>5% Permafresh MFK;<br>2% Witcobond W-293; and<br>1.25% Catalyst KR.<br>0.25% Tebefoam<br>0.5% Mykon XLT |

The fabrics were tested for water and oil repellency, spray rating and corn oil and mineral oil stain release by the methods described previously after 0 industrial washes, 5 industrial washes, 10 industrial washes, 20 industrial washes, and 30 industrial washes. Test results are shown in Table VIII.

Example 16

Comparative

| | |
|---|---|
| Example 16A: | The fabric of Example 13 was treated with the postcure application procedure previously described using the following competitive chemistry:<br>4% Scotchgard L-18542<br>10% Permafresh MFX<br>2.5% Catalyst KR<br>0.25% Tebefoam<br>0.5% Mykon XLT |
| Example 16B: | The fabric of Example 1 was treated with the one step application procedure previously described using the following competitive chemistry:<br>10% Zonyl 7040<br>2.0% Reactant 901<br>1% Free Cat (available from Noveon, Inc.)<br>0.4% Alkanol 6112 (a wetting agent) |

The fabric was tested after 0 industrial washes, 5 industrial washes, 10 industrial washes, 20 industrial washes, and 30 industrial washes. Test results are shown in Table VIII.

Example 17

A piece of nylon fabric was treated with the inventive chemistry of the current invention according to the one step application procedure described previously. The fabric was obtained from Milliken & Company of Spartanburg, S.C. The warp yarns were comprised of 70/34 denier filament nylon 6,6 fibers. The fill yarns were comprised of 2/070/66 denier filament nylon 6,6 fibers. The fiber was purchased from DuPont. The warp and fill yarns were woven together in a plain weave pattern having 106 warp yarns and 68 fill yarns per inch of fabric. The fabric was subsequently jet dyed and then face finished by light exposure to mechanical sanding. The finished fabric had a width of about 60 inches and a weight of about 4.8 ounces per yard.

The inventive chemistry included the following formulation (by weight % in the bath):

1. 2% Zonyl 7910
2. 2% Repearl F8025
3. 1.5% Arkophob DAN.

The wet pick up of the chemical bath on the fabric was about 52%.

The treated fabrics were tested for water and oil repellency, spray rating and corn oil and mineral oil stain release by the methods described previously after 0 home washes ("AR" indicates "As Received"), 5 home washes, and 10 home washes. Test results are shown in Table IX.

Example 18

Comparative

Example 17 was repeated, except that each chemical agent of the chemical composition was replaced with various competitive stain release and/or stain repellent chemicals. The chemicals used are as follows:

| | |
|---|---|
| Example 18A: | 3.0% Zonyl 7713 and 1% Repearl MF; |
| Example 18B: | 3.0% Scotchgard L-18369 and 1% Hydrophobol XAN; and |
| Example 18C: | 6.0% Scotchgard L-18542 and 1.5% Repearl MF. |

Test results are also shown in Table IX.

Example 19

A piece of Nomex® fabric was treated with the inventive chemistry of the current invention according to the one step application procedure described previously. The fabric was obtained from Milliken & Company of Spartanburg, S.C. The warp and fill yarns were comprised of 38/2 denier staple T-462 Nomex® fiber. The warp and fill yarns were woven together in a plain weave pattern having 67 warp yarns and 43 fill yarns per inch of fabric. The fabric was subsequently piece dyed and then finished by conventional means. The finished fabric had a width of about 60 inches and a weight of about 4.5 ounces per yard.

The inventive chemistry included the following formulation:

| | |
|---|---|
| Example 19A: | 2% Unidyne TG-992<br>1% Zonyl 7713<br>1.5% Arkophob DAN |
| Example 19B: | 0.25% Unidyne TG-992<br>1.75% Zonyl 7910<br>2% Repearl F8025<br>1.5% Arkophob DAN |
| Example 19C: | untreated fabric (contol). |

The wet pick up of the chemical bath on the fabric was about 93%.

The treated fabrics were tested for water and oil repellency, spray rating and corn oil and mineral oil stain release by the methods described previously after 0 home washes ("AR" indicates "As Received") and after 5 home washes. Test results are shown in Table X.

Each of these exemplified substrates was then tested for various surface properties:

C) Fabric Surface Analysis Procedures and Test Results:

I) Description of Followed Test Methods:

a) The Home Wash Procedure undertaken below to test for wash durability was conducted in accordance with AATCC Test Method 130-2000, using wash procedure 1 (105° F. wash) and Tide® Quick Dissolving Powder detergent.

The Industrial Wash Procedure was conducted in accordance with a standard procedure used by many large industrial laundry facilities. The procedure is identified as one used for colored blends of textile substrates and uses the following procedural steps:

| Operation | Time (Min) | Water Temperature (° F.) | Water Level | Usage/ 28 lbs load | Supply |
|---|---|---|---|---|---|
| Break | 16/1 | 165 | Low | 30 mL<br>340 mL<br>350 mL | Express<br>Horizon<br>Choice MP |
| Rinse | 2/1 | 150 | High | | |
| Rinse | 2/1 | 135 | High | | |
| Rinse | 2/1 | 120 | High | | |
| Sour | 4/1 | Cold | Low | 15 mL | P. Sour |
| Extract | 2 | | Low | | |

The load size for the industrial wash procedure was determined to be at 80% of machine capacity (28 lb load in a 35 lb machine). Total wash cycle time was about 33 minutes. The time shown, for example, as "16/1" indicates that the wash time was 16 minutes and the drain time was 1 minute. The chemicals used for washing were obtained from Washing Systems Inc. The chemicals were Choice MP, a concentrated non-ionic surfactant, Horizon, a silicated phosphate builder, Express, an alkali compound, and Sour, an acidic compound. The pH range of the wash cycle was maintained in a range of between about 10.2 and 10.8.

b) The Spray Rating Test was conducted in accordance with AATCC (American Association of Textile Chemists and Colorists) Test Method 22-2000. The rating scale is as follows:

100—No sticking or wetting of upper surface
90—Slight random sticking or wetting of upper surface
80—Wetting of upper surface at spray points
70—Partial wetting of whole of upper surface
50—Complete wetting of whole of upper surface
0—Complete wetting of whole upper and lower surfaces.

c) Stain Release was determined using AATCC Test Method 130-2000. The staining agents used in the Stain Release tests were corn oil (CO) and mineral oil (MI). The rating scale is 1-5, with "1" indicating the poorest degree of stain removal, and "5" indicating the best degree of stain removal. Generally, a rating of about 3.0 is the minimum acceptable stain level for normal wear and use.

d) Water Repellency was tested according to the 3M Water Repellency Test II (May, 1992). The rating scale is 0-10, with "0" indicating the poorest degree of repellency (substrates having higher surface energy) and "10" indicating the best degree of repellency (substrates having lower surface energy). The 3M Water Repellency Test scale is:

0 is 0% Isopropanol, 100% water (by weight)
1 is 10% IPA, 90% water
2 is 20% IPA, 80% water
3 is 30% IPA, 70% water
4 is 40% IPA, 60% water
5 is 50% IPA, 50% water
6 is 60% IPA, 40% water
7 is 70% IPA, 30% water
8 is 80% IPA, 20% water
9 is 90% IPA, 10% water
10 is 100% IPA e) Oil Repellency was tested according to the AATCC Test Method 118-2000. The rating scale is 0-8, with "0" indicating the poorest degree of repellency (substrates having higher surface energy) and "8" indicating the best degree of repellency (substrates having lower surface energy). The oil repellency scale is:

0 is Nujol™ Mineral Oil (the substrates wets with the oil)
1 is Nujol™ Mineral Oil
2 is 65/35 Nujol/n-hexadecane (by volume)
3 is n-hexadecane
4 is n-tetradecane
5 is n-dodecane
6 is n-decane
7 is n-octane
8 is n-heptane f) Kawabata Hand Testing A variety of characteristics were measured using the Kawabata Evaluation System ("Kawabata System"). The Kawabata System was developed by Dr. Sueo Kawabata, Professor of Polymer Chemistry at Kyoto University in Japan, as a scientific means to measure, in an objective and reproducible way, the "hand" of textile fabrics. This is achieved by measuring basic mechanical properties that have been correlated with aesthetic properties relating to hand (e.g. smoothness, fullness, stiffness, softness, flexibility, and crispness), using a set of four highly specialized measuring devices that were developed specifically for use with the Kawabata System. These devices are as follows:

Kawabata Tensile and Shear Tester (KES FB1)
Kawabata Pure Bending Tester (KES FB2)
Kawabata Compression Tester (KES FB3)
Kawabata Surface Tester (KES FB4)

KES FB1 through 3 are manufactured by the Kato Iron Works Col, Ltd., Div. Of Instrumentation, Kyoto, Japan. KES FB4 (Kawabata Surface Tester) is manufactured by the Kato Tekko Co., Ltd., Div. Of Instrumentation, Kyoto, Japan. In each case, the measurements were performed according to the standard Kawabata Test Procedures, with four 8-inch×8-inch samples of each type of fabric being tested, and the results averaged. Care was taken to avoid folding, wrinkling, stressing, or otherwise handling the samples in a way that would deform the sample. The fabrics were tested in their as-manufactured form (i.e. they had not undergone subsequent launderings.) The die used to cut each sample was aligned with the yarns in the fabric to improve the accuracy of the measurements.

i) Shear Measurements

The testing equipment was set up according to the instructions in the Kawabata manual. The Kawabata shear tester (KES FB1) was allowed to warm up for at least 15 minutes before being calibrated. The tester was set up as follows:

Sensitivity: 2 and X5
Sample width: 20 cm
Shear weight: 195 g
Tensile Rate: 0.2 mm/s
Elongation Sensitivity: 25 mm The shear test measures the resistive forces when the fabric is given a constant tensile force and is subjected to a shear deformation in the direction perpendicular to the constant tensile force.

Mean Shear Stiffness (G) [gf/(cm−deg)]. Mean shear stiffness was measured in each of the warp and filling directions. A lower value for shear stiffness is indicative of a more supple hand.

Four samples were taken in each of the warp and filling directions, and are listed below.

ii) Bending Measurements

Bending Stiffness (B)—A lower value means a fabric is less stiff. Four samples were taken in each of the warp and filling directions.

iii) Compression Analysis

The testing equipment was set up according to the instructions in the Kawabata manual. The Kawabata Compression Tester (KES FB3) was allowed to warm up for at least 15 minutes before being calibrated. The tester was set up as follows:

Sensitivity: 2 and X5
Stroke: 5 mm
Compression Rate: 1 mm/50s
Sample Size: 20×20 cm The compression test measured the resistive forces experienced by a plunger having a certain surface area as it moves alternately toward and away from a fabric sample in a direction perpendicular to the fabric. The test ultimately measures the work done in compressing the fabric (forward direction) to a preset maximum force and the work done while decompressing the fabric (reverse direction).

Percent compressibility at 0.5 grams (COMP05) The higher the measurement, the more compressible the fabric.

Maximum Thickness (TMAX)—Thickness [mm] at maximum pressure (nominal is 50 gf/cm$^2$). A higher TMAX indicates a loftier fabric.

Minimum Thickness (TMIN) Thickness at 0.5 g/sq cm. More is generally considered to be better. A higher TMIN indicates a loftier fabric.

Minimum Density—Density at TMIN (DMIN). Less is generally considered to be better) $T_{min}$[g/cm$^3$]

Maximum Density—Density at TMAX (DMAX)— $T_{max}$ [g/cm$^3$] A lower value is generally considered to be better.

Compressional Work Per Unit Area (WC) Energy to compress fabric to 50 gf/cm$^2$-[gf-cm/cm$^2$]. More is generally considered to be better.

Decompressional Work per Unit Area (WC') This is an indication of the resilience of the fabric. A larger number indicates more resilience (i.e. a springier hand), which is generally considered to be better.

iv) Surface Analysis

The testing equipment was set up according to the instructions in the Kawabata Manual. The Kawabata Surface Tester (KES FB4) was allowed to warm up for at least 15 minutes before being calibrated. The tester was set up as follows:

Sensitivity 1: 2 and X5
Sensitivity 2: 2 and X5
Tension Weight: 480 g
Surface Roughness Weight: 10 g
Sample Size: 20×20 cm The surface test measures frictional properties and geometric roughness properties of the surface of the fabric.

Coefficient of Friction—(MIU) Mean coefficient of friction [dimensionless]. This was tested in each of the warp and filling directions. A higher value indicates that the surface consists of more fiber ends and loops, which gives the fabric a soft, fuzzy hand. Four samples were taken in each of the warp and filling directions, and are listed below.

Surface roughness (SMD) Mean deviation of the displacement of contactor normal to surface [microns]. Indicative of how rough the surface of the fabric is. A lower value indicates that a fabric surface has more fiber ends and loops that give a fabric a softer, more comfortable hand. Four samples were taken in each of the warp and filling directions, and are listed below.

g) The Dry Cleaning Test Method was conducted by placing an approximately 6 inch by 6 inch piece of fabric into a 1 quart jar with 250 ml perchloroethylene. The jar was shaken vigorously for 5 minutes. The fabric was then removed and allowed to air dry for a minimum of 8 hours. This Method if hereinafter referred to as "The Dry Cleaning Method".

h) The Static Test Method was conducted by placing an approximately 3 inch by 8 inch piece of fabric onto the laboratory bench. The sample was briskly rubbed (in one direction) 20 times with a fresh paper towel. A Simco FM300 Electrostatic Fieldmeter was immediately placed approximately 1 inch away from fabric, and the button was pressed to make the measurement. The result obtained was recorded in kilovolts. To obtain results after conditioning the fabric, the fabric sample was placed overnight into an environmentally controlled room at 70 degrees F. and 65% relative humidity. The measurement was repeated on the conditioned sample.

i) Advancing and Receding Contact Angles were measured using the following two instruments and procedures:

1) Tensiometer Test Method: Tensiometry as used herein, involves a gravimetric measurement of the forces of interaction as a solid is contacted with a test liquid (Wilhelmy method). These forces of interaction are a dynamic measurement and reflect the interactions of the entire immersed article (wetted length). Forces are measured as the article is advanced into and out of a test liquid. From these measurements, both advancing and receding contact angles, respectively, can be calculated (Wilhelmy equation) in an indirect manner.

ii) Goniometer Test Method: Goniometry, as used herein, involves the optical observation of a sessile drop of test liquids on a solid substrate. Tangent angles are measured for each test liquid providing the direct measurement of an "advanced" (static) contact angle. These angles only reflect the average forces imparted from the area under the drop (footprint) and not the bulk of the article. These angle calculations can be used to determine surface energies and corresponding components.

Both Goniometer and Tensiometer Test Methods achieve similar results with the goniometer being of a small area and a static measurement.

j) X-ray Photoelectron Spectroscopy (XPS) was used to perform the surface chemical analysis shown in Example 28 and in FIGS. 1 and 2. XPS is described as follows:

Since the first use of XPS to probe polymer surfaces, as described in *The Journal of Polymer Science and Polymer Chemistry Ed.* (1977, vol. 15, p. 2843) by D. T. Clark and H. R. Thomas, it has become a standard, quantitative tool for their characterization. The energy-analyzed electrons, photoemitted during irradiation of a solid sample by monochromatic X-rays, exhibit sharp peaks which correspond to the binding energies of core-level electrons in the sample. The peaks of these binding energies can be used to identify the chemical constituents in the specimen.

The mean free path of electrons in solids is very short ($\lambda$~2.3 nm). For reference, see *Macromolecules* (1988, vol. 21, p. 2166) by W. S. Bhatia, D. H. Pan, and J. T. Koberstein. The effective sampling depth, Z, of XPS can be calculated by $Z=3\lambda \cos \theta$, where $\theta$ is the angle between the surface normal and the emitted electron path to the analyzer. So the maximum depth that can be probed is about 7 nm at $\theta=0$. For typical atomic components of polymers, C, N, and O, optimized XPS can detect compositions of 0.2 atom percent. XPS is also very sensitive to F and Si. Such quantitative information is very useful in understanding polymer surface behaviors.

X-ray photoelectron spectroscopy (XPS) was employed here to examine the chemical composition of the modified textile surfaces and, furthermore, to evaluate the surface chemical composition change under different environmental situations. XPS spectra were obtained using a Perkin-Elmer Model 5400×PS spectrometer with a Mg K$\alpha$ X-ray source (1253.6 eV), operated at 300 W and 14 kV DC, with an emission current of 25 mA. The spot size was 1.0×3.0 mm. Photoelectrons were analyzed in a hemispherical analyzer using a position-sensitive detector.

II) Analysis Results:

"N/A" or "NA" shown in the Tables indicates that test data was not available for that item.

Test results for Examples 1-4 are presented in Table IA. The results of Example 1 illustrate the durability of the inventive chemistry on polyester fabric in maintaining high levels of water and oil repellency while at the same time maintaining acceptable levels of stain release through at least 30 home wash cycles.

The results of Example 2 illustrate the versatility of the inventive chemistry in having the ability to maximize stain repellency performance (i.e., spray rating improves with decreasing amounts of Unidyne TG-992) at the expense of stain release performance (i.e., mineral oil release decreases with smaller amounts of Unidyne TG-992) and, conversely, the ability to maximize stain release performance (i.e., mineral oil release is higher with greater amounts of Unidyne TG-992) at the expense of stain repellency performance (spray rating is lower with greater amounts of Unidyne TG-992). This versatility allows the inventive chemistry to be tailored for specific end-use applications such as rainwear, wherein water repellency may be more desirable, or workwear, wherein stain release may be more desirable.

The results of Comparative Example 3 illustrate the superior performance obtained by the unique combination of chemical agents disclosed by the current invention. Without this unique combination, and as shown in Comparative Examples 3A-3C, repellency, spray rating, and stain release performance characteristics are not optimized.

The results of Example 4 illustrate that alternative chemicals may be used for the fluorinated stain repellent and stain release agents, when proportionately combined with the other chemical agents of the chemical composition, to provide durable repellency, spray rating, and stain release through at least 30 home wash cycles.

TABLE IA

Microdenier Polyester Textile Substrate with Inventive and Comparative Treatments (Home Wash)

| | Example | | | | | | | | | |
|---|---|---|---|---|---|---|---|---|---|---|
| | Ex. 1 | Ex. 2A | Ex. 2B | Ex. 2C | Ex. 3A | Ex. 3B | Ex. 3C | Ex. 4A | Ex. 4B | Ex. 4C |
| Oil Repellency: AR | 5 | 6 | 6 | 6 | 6 | 5 | N/A | 6 | 6 | 6 |
| Water Repellency: AR | 9 | 9 | 8 | 9 | 9 | 9 | 9 | 9 | 8 | 8 |
| Spray Rating: AR | 80 | 70 | 70 | 80 | N/A | 80 | N/A | N/A | 70 | 90 |
| Corn Oil Release: 0/1 AR | 4.5 | 4.5 | 4 | 2 | 4 | 5 | 5 | 5 | 5 | 5 |
| Mineral Oil Release: 0/1 AR | 5 | 4 | 4 | 1 | N/A | 5 | N/A | N/A | 4.5 | 5 |
| Oil Repellency: 10 Wash | 4 | 5 | 6 | 5 | 5 | 2 | 3 | 3 | 5 | 5 |
| Water Repellency: 10 Wash | 7 | 8 | 8 | 7 | 6 | 5 | 5 | 6 | 8 | 5 |
| Spray Rating: 10 Wash | 70 | 70 | 70 | 100 | N/A | 70 | N/A | N/A | 70 | 80 |
| Corn Oil Release: 9/10 | 4.5 | 5 | 5 | 3.5 | 3.5 | 4.5 | 5 | 5 | 5 | 5 |
| Mineral Oil release: 9/10 | 4 | 4 | 1 | 1 | N/A | 4.5 | N/A | N/A | 4.5 | 2.5 |
| Oil Repellency: 20 Wash | 4 | 3 | 5 | 5 | 4 | <1 | 2 | N/A | 5 | 5 |
| Water Repellency: 20 Wash | 7 | 7 | 7 | 7 | 5 | 2 | 3 | N/A | 7 | 5 |
| Spray Rating: 20 Wash | 70 | N/A | N/A | N/A | N/A | N/A | N/A | N/A | N/A | N/A |
| Corn Oil Release: 19/20 | 4 | N/A | N/A | N/A | N/A | 5 | N/A | N/A | N/A | N/A |
| Mineral Oil Release: 19/20 | 3.5 | N/A | N/A | N/A | N/A | 4.5 | N/A | N/A | N/A | N/A |
| Oil Repellency: 30 Wash | 4 | 2 | 5 | 5 | 4 | <1 | 1 | N/A | 4 | 5 |
| Water Repellency: 30 Wash | 6 | 4 | 5 | 5 | 4 | <1 | 3 | N/A | 5 | 5 |
| Spray Rating: 30 Wash | 70 | 50 | 70 | 90 | N/A | 50 | N/A | N/A | 50 | 70 |
| Corn Oil Release: 29/30 | 4 | 4.5 | 4 | 4 | N/A | 5 | 5 | N/A | 4.5 | 4.5 |
| Mineral Oil Release: 29/30 | 3 | 3.5 | 1 | 1 | N/A | 4.5 | N/A | N/A | 4.5 | 2.5 |
| Oil Repellency: 40 Wash | 4 | N/A | N/A | N/A | N/A | N/A | N/A | | | |
| Water Repellency: 40 Wash | 3 | N/A | N/A | N/A | N/A | N/A | N/A | | | |
| Spray Rating: 40 Wash | N/A | N/A | N/A | N/A | N/A | N/A | N/A | | | |
| Corn Oil Release: 39/40 | N/A | N/A | N/A | N/A | N/A | N/A | N/A | | | |
| Mineral Oil Release: 39/40 | N/A | N/A | N/A | N/A | N/A | N/A | N/A | | | |
| Oil Repellency: 50 Wash | 4 | N/A | N/A | N/A | N/A | N/A | N/A | | | |
| Water Repellency: 50 Wash | 3 | N/A | N/A | N/A | N/A | N/A | N/A | | | |
| Spray Rating: 50 Wash | N/A | N/A | N/A | N/A | N/A | N/A | N/A | | | |
| Corn Oil Release: 49/50 | N/A | N/A | N/A | N/A | N/A | N/A | N/A | | | |
| Mineral Oil Release: 49/50 | N/A | N/A | N/A | N/A | N/A | N/A | N/A | | | |

Test results for Example 5 are shown in Table 1B. The results illustrate the durability and versatility of the inventive chemistry on substrates, such as polyester bedspread fabrics, having various constructions and fiber deniers. The results further illustrate the durability and versatility of textile substrates comprised of flat (rather than textured) polyester and of textile substrates that have not been exposed to a face finishing sanding process.

TABLE IB

Polyester Bedspread Fabric with Inventive Treatments (Industrial Wash)

| | Example | | | |
|---|---|---|---|---|
| | Ex. 5A | Ex. 5B | Ex. 5C | Ex. 5D |
| Oil Repellency: AR | 5 | 5 | 6 | 6 |
| Water Repellency: AR | 6 | 6 | 6 | 6 |
| Spray Rating: AR | 70 | 90 | 70 | 80 |
| Corn Oil Release: 0/1 AR | 4.5 | 4.5 | 4 | 4.5 |
| Mineral Oil Release: 0/1 AR | 4.5 | 4 | 4 | 4 |
| Oil Repellency: 5 Wash | 5 | 5 | 4 | 5 |
| Water Repellency: 5 Wash | 6 | 6 | 6 | 6 |
| Spray Rating: 5 Wash | 70 | 90 | 70 | 80 |
| Corn Oil Release: 4/5 | 4.5 | 4.5 | 3 | 4.5 |
| Mineral Oil release: 4/5 | 4.5 | 4.5 | 3.5 | 4.5 |

Test results for Comparative Example 6 are shown in Table II. The results illustrate that the inventive chemistry, shown as Example 1, provides durable repellency, spray rating, and stain release through at least 30 home wash cycles over the competitive chemistry, shown as Example 6A through 6J, provided herein for comparison on the same microdenier polyester substrate.

TABLE II

Microdenier Polyester Textile Substrate with Comparative Treatments (Home Wash)

| | Example | | | | | |
|---|---|---|---|---|---|---|
| | Ex. 1 | Ex. 6A | Ex. 6B | Ex. 6C | Ex. 6D | Ex. 6E |
| Oil Repellency: AR | 5 | 5 | 5 | 4 | 5 | 4 |
| Water Repellency: AR | 9 | 6 | 10 | 2 | 7 | 3 |
| Spray Rating: AR | 80 | 90 | 90 | N/A | 50 | 80 |
| Corn Oil Release: 0/1 | 4.5 | 4 | 1 | 5 | 4.5 | 5 |
| Mineral Oil Release: 0/1 | 5 | 4 | 1 | 4 | 4.5 | 5 |
| Oil Repellency: 10 Wash | 4 | 5 | 5 | 5 | 0 | 0 |
| Water Repellency: 10 Wash | 7 | 5 | 9 | 3 | 0 | 0 |
| Spray Rating: 10 Wash | 70 | 90 | 90 | N/A | 0 | 0 |
| Corn Oil Release: 9/10 | 4.5 | 2 | 1 | 5 | 4 | 4.5 |
| Mineral Oil release: 9/10 | 4 | 1 | 1 | 5 | 4 | 4.5 |
| Oil Repellency: 20 Wash | 4 | 5 | 5 | 5 | 0 | N/A |
| Water Repellency: 20 Wash | 7 | 5 | 7 | 3 | 0 | N/A |
| Spray Rating: 20 Wash | 70 | 70 | 80 | N/A | 0 | N/A |
| Corn Oil Release: 19/20 | 4 | 1 | 1 | 5 | 4 | N/A |
| Mineral Oil Release: 19/20 | 3.5 | 1 | 1 | 5 | 4 | N/A |
| Oil Repellency: 30 Wash | 4 | 4 | 5 | 5 | 0 | N/A |
| Water Repellency: 30 Wash | 4 | 4 | 7 | 3 | 0 | N/A |
| Spray Rating: 30 Wash | 70 | 80 | 50 | N/A | 0 | N/A |
| Corn Oil Release: 29/30 | 4 | 3.5 | 1 | 5 | 4 | N/A |
| Mineral Oil Release: 29/30 | 3 | 1 | 1 | 5 | 3.5 | N/A |
| Oil Repellency: 40 Wash | 4 | N/A | N/A | N/A | N/A | N/A |
| Water Repellency: 40 Wash | 3 | N/A | N/A | N/A | N/A | N/A |
| Spray Rating: 40 Wash | N/A | N/A | N/A | N/A | N/A | N/A |

TABLE II-continued

| Microdenier Polyester Textile Substrate with Comparative Treatments (Home Wash) | | | | | | |
|---|---|---|---|---|---|---|
| Corn Oil Release: 39/40 | N/A | N/A | N/A | N/A | N/A | N/A |
| Mineral Oil Release: 39/40 | N/A | N/A | N/A | N/A | N/A | N/A |
| | | N/A | N/A | N/A | N/A | N/A |
| Oil Repellency: 50 Wash | 4 | N/A | N/A | N/A | N/A | N/A |
| Water Repellency: 50 Wash | 3 | N/A | N/A | N/A | N/A | N/A |
| Spray Rating: 50 Wash | N/A | N/A | N/A | N/A | N/A | N/A |
| Corn Oil Release: 49/50 | N/A | N/A | N/A | N/A | N/A | N/A |
| Mineral Oil Release: 49/50 | N/A | N/A | N/A | N/A | N/A | N/A |

| | Example | | | | |
|---|---|---|---|---|---|
| | Ex. 6F | Ex. 6G | Ex. 6H | Ex. 6I | Ex. 6J |
| Oil Repellency: AR | 5 | 4 | 2 | 5 | 5 |
| Water Repellency: AR | 3 | 3 | 4 | 8 | 7 |
| Spray Rating: AR | 70 | 100 | 90 | 70 | 80 |
| Corn Oil Release: 0/1 | 4 | 3.5 | 1 | 4.5 | 4.5 |
| Mineral Oil Release: 0/1 | 4 | 3 | 1 | 4 | 5 |
| Oil Repellency: 10 Wash | 2 | 3 | 2 | 2 | 4 |
| Water Repellency: 10 Wash | 2 | 3 | 3 | 4 | 5 |
| Spray Rating: 10 Wash | 50 | 50 | 50 | 50 | 70 |
| Corn Oil Release: 9/10 | 4 | 3 | 1 | 4 | 4.5 |
| Mineral Oil release: 9/10 | 5 | 1 | 1 | 5 | 4 |
| Oil Repellency: 20 Wash | 0 | 3 | 2 | 2 | 4 |
| Water Repellency: 20 Wash | 2 | 3 | 3 | 2 | 5 |
| Spray Rating: 20 Wash | 50 | N/A | 50 | 50 | 70 |
| Corn Oil Release: 19/20 | 4 | 3 | 1 | 4 | 4 |
| Mineral Oil Release: 19/20 | 5 | 1 | 1 | 4 | 3.5 |
| Oil Repellency: 30 Wash | 0 | N/A | N/A | 2 | 4 |
| Water Repellency: 30 Wash | 0 | N/A | N/A | 2 | 4 |
| Spray Rating: 30 Wash | 0 | N/A | N/A | 50 | 70 |
| Corn Oil Release: 29/30 | 4 | N/A | N/A | 5 | 4 |
| Mineral Oil Release: 29/30 | 4 | N/A | N/A | 4 | 3 |
| Stain Release - BMO 0/1 | N/A | N/A | N/A | N/A | N/A |
| Stain Release - BMO 4/5 | N/A | N/A | N/A | N/A | N/A |
| Stain Release - BMO 9/10 | N/A | N/A | N/A | N/A | N/A |

Test results for Examples 7 (Comparative) and 8 (Inventive) are shown in Table III. The results for Example 7 illustrate the durability of the inventive chemistry on polyester fabric in maintaining high levels of water and oil repellency while at the same time maintaining acceptable levels of stain release through at least 5 home wash cycles. The results further show the versatility of the inventive chemistry with various chemical application techniques and procedures.

The results of Example 8 illustrate the durability of the inventive chemistry on polyester fabric in maintaining high levels of water and oil repellency while at the same time maintaining acceptable levels of stain release through at least 30 home wash cycles. The results further show that the alternative two step application procedure may provide greater spray rating results, while maintaining high levels of repellency and corn oil release, than the one step application procedure.

TABLE III

| Polyester Textile Substrate with Inventive and Comparative Treatments Using Two Step Application Procedure (Home Wash) | | |
|---|---|---|
| | Example | |
| | Ex. 7 | Ex. 8 |
| Oil Repellency: AR | 6 | 6 |
| Water Repellency: AR | 6 | 7 |
| Spray Rating: AR | N/A | 100 |
| Corn Oil Release: 0/1 | 4 | 4 |
| Mineral Oil Release: 0/1 | 4 | N/A |
| Oil Repellency: 5 Wash | 5 | 6 |
| Water Repellency: 5 Wash | 7 | 6 |
| Spray Rating: 5 Wash | N/A | 100 |
| Corn Oil Release: 4/5 | 4 | 5 |
| Mineral Oil release: 4/5 | 3.5 | N/A |
| Oil Repellency: 30 Wash | N/A | 5 |
| Water Repellency: 30 Wash | N/A | 5 |
| Spray Rating: 30 Wash | N/A | 100 |
| Corn Oil Release: 29/30 | N/A | 4.5 |
| Mineral Oil Release: 29/30 | N/A | 1.5 |

Test results for Example 9, Example 10, and Comparative Example 11 are presented in Table IV. The results of Example 9 illustrate the durability of the inventive chemistry on cotton fabric in maintaining high levels of water and oil repellency while at the same time maintaining acceptable levels of stain release through 30 home wash cycles, as noted below.

The results of Example 10 illustrate the versatility of the inventive chemistry in having the ability to maximize stain repellency performance (i.e., spray rating improves with decreasing amounts of Unidyne TG-992) at the expense of stain release performance (i.e., mineral oil release decreases with smaller amounts of Unidyne TG-992) and, conversely, the ability to maximize stain release performance (i.e., mineral oil release is higher with greater amounts of Unidyne TG-992) at the expense of stain repellency performance (spray rating is lower with greater amounts of Unidyne TG-992). This versatility allows the inventive chemistry to be tailored for specific end-use applications such as rainwear, wherein water repellency may be more desirable, or workwear, wherein stain release may be more desirable.

The results of Example 11 illustrate the superior performance obtained by the unique combination of chemical agents disclosed by the current invention. Without this unique combination, and as shown, for example, in Examples 10A-10C, repellency, spray rating, and stain release performance characteristics are not optimized.

TABLE IV

| Cotton Textile Substrate with Inventive and Comparative Treatments (Home Wash) | | | | | | | |
|---|---|---|---|---|---|---|---|
| | Example | | | | | | |
| | Ex. 9 | Ex. 10A | Ex. 10B | Ex. 10C | Ex. 11A | Ex. 11B | Ex. 11C |
| Oil Repellency: AR | 6 | 6 | 6 | 6 | 5 | 7 | 6 |
| Water Repellency: AR | 3 | 3 | 3 | 3 | 5 | 7 | 8 |

TABLE IV-continued

Cotton Textile Substrate with Inventive and Comparative Treatments (Home Wash)

| | Example | | | | | | |
|---|---|---|---|---|---|---|---|
| | Ex. 9 | Ex. 10A | Ex. 10B | Ex. 10C | Ex. 11A | Ex. 11B | Ex. 11C |
| Spray Rating: AR | 80 | 70 | 80 | 80 | N/A | 70 | 80 |
| Corn Oil Release: 0/1 | 4 | 5 | 5 | 5 | 1 | 5 | 5 |
| Mineral Oil Release: 0/1 | 3.5 | 5 | 4.5 | 4.5 | 1 | 4.5 | 5 |
| Oil Repellency: 10 Wash | 6 | 4 | 4 | 5 | 6 | 2 | 0 |
| Water Repellency: 10 Wash | 5 | 3 | 3 | 3 | 7 | 2 | 0 |
| Spray Rating: 10 Wash | 70 | 50 | 50 | 50 | N/A | 50 | N/A |
| Corn Oil Release: 9/10 | 4 | 4.5 | 5 | 5 | 1 | 4.5 | 4 |
| Mineral Oil release: 9/10 | 3.5 | 4.5 | 5 | 5 | 1 | 4 | 3.5 |
| Oil Repellency: 20 Wash | 5 | 1 | 1 | 1 | N/A | 1 | 0 |
| Water Repellency: 20 Wash | 4 | 2 | 2 | 3 | N/A | 0 | 0 |
| Spray Rating: 20 Wash | N/A | N/A | N/A | N/A | N/A | N/A | N/A |
| Corn Oil Release: 19/20 | N/A | N/A | N/A | N/A | N/A | N/A | N/A |
| Mineral Oil Release: 19/20 | N/A | N/A | N/A | N/A | N/A | N/A | N/A |
| Oil Repellency: 30 Wash | 5 | 0 | 1 | 2 | 3 | 0 | 0 |
| Water Repellency: 30 Wash | 5 | 0 | 2 | 2 | 4 | 0 | 0 |
| Spray Rating: 30 Wash | 50 | 0 | 50 | 0 | N/A | 50 | N/A |
| Corn Oil Release: 29/30 | 4 | 4 | 3.5 | 4 | 1 | 4 | 2.5 |
| Mineral Oil Release: 29/30 | 3 | 3.5 | 3 | 3.5 | 1 | 3 | 2 |

Test results for Comparative Example 12 and Inventive Example 9 are shown in Table V. The results illustrate that the inventive chemistry provides durable repellency, spray rating, and stain release through at least home 30 washes over the competitive chemistry provided herein for comparison using the same substrate.

TABLE V

Cotton Textile Substrate with Inventive and Comparative Treatments (Home Wash)

| | Example | | | | | | | | | | |
|---|---|---|---|---|---|---|---|---|---|---|---|
| | Ex. 9 | Ex. 12A | Ex. 12B | Ex. 12C | Ex. 12D | Ex. 12E | Ex. 12F | Ex. 12G | Ex. 12H | Ex 12I | 12J |
| Oil Repellency: AR | 6 | 4 | 5 | 5 | 4 | N/A | 5 | 4 | 2 | 3 | 4 |
| Water Repellency: AR | 3 | 6 | 5 | 2 | 6 | N/A | 5 | 3 | 4 | 6 | 7 |
| Spray Rating: AR | 80 | 80 | 90 | 70 | 80 | N/A | 70 | 100 | 90 | 50 | 80 |
| Corn Oil Release: 0/1 | 4 | 3 | N/A | 3.5 | 5 | N/A | 5 | 3.5 | 1 | 4 | 1 |
| Mineral Oil Release: 0/1 | 3.5 | 1 | N/A | 3.5 | 4 | N/A | 5 | 3 | 1 | 4 | 1 |
| Oil Repellency: 10 Wash | 6 | 2 | 3 | 5 | 2 | N/A | 0 | 3 | 2 | 0 | 1 |
| Water Repellency: 10 Wash | 5 | 1 | 3 | 3 | 1 | N/A | 0 | 3 | 3 | 0 | 1 |
| Spray Rating: 10 Wash | 70 | 50 | 70 | 70 | 50 | N/A | 50 | 50 | 50 | 0 | 50 |
| Corn Oil Release: 9/10 | 4 | 3 | N/A | 2.5 | 3.5 | N/A | 4 | 3 | 1 | 4 | 4 |
| Mineral Oil release: 9/10 | 3.5 | 1 | N/A | 4 | 2 | N/A | 3 | 1 | 1 | 3.5 | 1 |
| Oil Repellency: 20 Wash | 5 | 0 | 2 | 5 | 0 | N/A | 0 | 3 | 2 | 0 | 0 |
| Water Repellency: 20 Wash | 4 | 0 | 2 | 1 | 0 | N/A | 0 | 3 | 3 | 0 | 0 |
| Spray Rating: 20 Wash | N/A | 0 | 50 | 50 | 0 | N/A | 0 | N/A | 50 | 0 | 50 |
| Corn Oil Release: 19/20 | N/A | 2 | N/A | 3 | 2 | N/A | 4 | 3 | 1 | 3 | 3 |
| Mineral Oil Release: 19/20 | N/A | 1 | N/A | 3 | 1 | N/A | 3 | 1 | 1 | 3 | 1 |
| Oil Repellency: 30 Wash | 5 | 0 | 1 | 4 | 0 | N/A | 0 | N/A | N/A | 0 | 0 |
| Water Repellency: 30 Wash | 5 | 0 | 2 | 1 | 0 | N/A | 0 | N/A | N/A | 0 | 0 |
| Spray Rating: 30 Wash | 50 | 0 | 50 | 50 | 0 | N/A | 0 | N/A | N/A | 0 | 50 |
| Corn Oil Release: 29/30 | 4 | 3 | N/A | 1 | 2 | N/A | 3 | N/A | N/A | 3 | 3 |
| Mineral Oil Release: 29/30 | 3 | 1 | N/A | 1 | 1 | N/A | 2 | N/A | N/A | 2 | 1 |

Test results for Example 13 are presented in Table VI. The results illustrate the durability of the inventive chemistry on polyester and cotton blend fabric in maintaining high levels of water and oil repellency while at the same time maintaining acceptable levels of stain release through at least 30 home wash cycles. The results further show the versatility of the inventive chemistry in applications where the permanent press resin is either fully cured during textile finishing or in applications where the resin is partially cured during textile finishing and then fully cured after garment manufacturing to obtain durable garment creases (i.e., postcure). Both processes provide high levels of water and oil repellency, acceptable levels of stain release, and acceptable levels of spray rating.

TABLE VI

Polyester Cotton Blend Textile Substrate with Inventive Treatments (Home Wash)

| | Example | | | | |
|---|---|---|---|---|---|
| | Ex. 13A | Ex. 13B | Ex. 13C | Ex. 13D | Ex. 13E |
| Testing Location | Production | Production | Production | Lab | Lab |
| Trial Location | Production | Production | Production | Lab | Lab |
| Repel-Water AR | 4 | 6 | 5 | 10 | 10 |
| Repel-Water 5 Wash | 4 | 5 | 5 | 9 | 9 |
| Repel-Water 10 Wash | 4 | 5 | 5 | 9 | 9 |
| Repel-Water 20 Wash | 3 | 4 | 4 | 7 | 6 |
| Repel-Water 30 Wash | 2 | 3 | 3 | 5 | 4 |
| Repel-Oil AR | 5 | 6 | 5 | 7 | 6 |
| Repel-Oil 5 Wash | 4 | 5 | 5 | 6 | 6 |
| Repel-Oil 10 Wash | 2 | 5 | 5 | 6 | 5 |
| Repel-Oil 20 Wash | 1 | 4 | 3 | 5 | 4 |
| Repel-Oil 30 Wash | 1 | 2 | 2 | 4 | 2 |
| Spray AR | 70 | 80 | 80 | 70 | 70 |
| Spray 5 Wash | 70 | 90 | 80 | 70 | 70 |
| Spray 10 Wash | 70 | 80 | 70 | 70 | 70 |
| Spray 20 Wash | 70 | 70 | 80 | 70 | 70 |
| Spray 30 Wash | 70 | 70 | 70 | 70 | 50 |
| Stain Release - Corn 0/1 0/2 | 3.5/4.0 | 4.0/4.5 | 4.0/4.5 | 5/NA | 5/NA |
| Stain Release - Corn 4/5 4/6 | 4.0/4.5 | 4.0/4.5 | 4.0/4.5 | 5/NA | 4.5/NA |
| Stain Release - Corn 9/10 9/11 | 4.0/4.5 | 3.5/4.5 | 3.0/3.5 | 5/NA | 4.5/NA |
| Stain Release - Corn 19/20 19/21 | 3.5/4.0 | 4.0/4.5 | 4.0/4.5 | 4/NA | 3.5/NA |
| Stain Release - Corn 29/30 29/31 | 3.5/4.0 | 3.5/4.0 | 4.0/4.5 | 4/NA | 3.5/NA |
| Stain Release - Mineral 0/1 0/2 | 3.5/4.0 | 4.0/4.5 | 4.0/4.5 | 5/NA | 4.5/NA |
| Stain Release - Mineral 4/5 4/6 | 4.0/4.5 | 4.0/4.5 | 3.5/4.5 | 5/NA | 4.5/NA |
| Stain Release - Mineral 9/10 9/11 | 4.0/4.5 | 3.0/4.0 | 3.0/3.5 | 5/NA | 4.5/NA |
| Stain Release - Mineral 19/20 19/21 | 3.0/3.5 | 4.0/4.5 | 4.0/4.5 | 4/NA | 3.5/NA |
| Stain Release - Mineral 29/30 29/31 | 3.0/3.5 | 3.0/3.5 | 4.0/4.5 | 4/NA | 3.5/NA |

TABLE VI-continued

Polyester Cotton Blend Textile Substrate with Inventive Treatments (Home Wash)

| | Example | | | |
|---|---|---|---|---|
| | Ex. 13F | Ex. 13G | Ex. 13H | Ex. 13I |
| Testing Location | Lab | Lab | Lab | Lab |
| Trial Location | Lab | Lab | Lab | Lab |
| Repel-Water AR | 10 | 10 | 10 | 10 |
| Repel-Water 5 Wash | 8 | 7 | 8 | 6 |
| Repel-Water 10 Wash | 5 | 3 | 6 | 3 |
| Repel-Water 20 Wash | 2 | 2 | 2 | 2 |
| Repel-Water 30 Wash | 1 | 1 | 1 | 0 |
| Repel-Oil AR | 6 | 6 | 7 | 6 |
| Repel-Oil 5 Wash | 6 | 5 | 6 | 5 |
| Repel-Oil 10 Wash | 5 | 4 | 5 | 3 |
| Repel-Oil 20 Wash | 2 | 2 | 4 | 2 |
| Repel-Oil 30 Wash | 1 | 1 | 2 | 0 |
| Spray AR | 80 | 80 | 70 | 70 |
| Spray 5 Wash | 70 | 70 | 70 | 70 |
| Spray 10 Wash | 70 | 70 | 70 | 70 |
| Spray 20 Wash | 70 | 50 | 70 | 50 |
| Spray 30 Wash | 50 | 50 | 50 | 50 |
| Stain Release - Corn 0/1 | 4.5 | 4.5 | 4.5 | 5 |
| Stain Release - Corn 4/5 | 4.5 | 5 | 5 | 4.5 |
| Stain Release - Corn 9/10 | 3.5 | 4.5 | 4 | 3.5 |
| Stain Release - Corn 19/20 | 3.5 | 3.5 | 4 | 3.5 |
| Stain Release - Corn 29/30 | 3 | 3 | 3.5 | 3.5 |
| Stain Release - Mineral 0/1 | 4.5 | 4.5 | 4.5 | 4.5 |
| Stain Release - Mineral 4/5 | 4.5 | 5 | 5 | 4 |
| Stain Release - Mineral 9/10 | 4 | 4.5 | 4 | 3.5 |
| Stain Release - Mineral 19/20 | 3.5 | 3.5 | 3.5 | 3.5 |
| Stain Release - Mineral 29/30 | 3 | 3 | 3 | 3 |

Test results of Comparative Example 14 are shown in Table VII. The results illustrate that the inventive chemistry, shown as Example 13A through 13J, provides durable repellency, spray rating, and stain release through at least 30 home washes over the competitive chemistry, shown as Example 13A through 14H, provided herein for comparison on the same polyester cotton blend substrate.

TABLE VII

Polyester Cotton Blend Textile Substrate with Comparative Treatments (Home Wash)

| | Example | | | | | |
|---|---|---|---|---|---|---|
| | Ex. 14A | Ex. 14B | Ex. 14C | Ex. 14D | Ex. 14E | Ex. 14F |
| Testing Location | Production | Production | Production | Production | Production | Production |
| Trial Location | Production | Production | Production | Production | Market | Market |
| Repel-Water AR | 0 | 6 | 6 | 5 | 5.0 | 5.0 |
| Repel-Water 5 Wash | 0 | 4 | N/A | N/A | N/A | 5.0 |
| Repel-Water 10 Wash | 0 | 3 | 4 | 4 | 3.0 | 4.0 |
| Repel-Water 20 Wash | 0 | 3 | 4 | 2 | 2.0 | 2.0 |

TABLE VII-continued

| Polyester Cotton Blend Textile Substrate with Comparative Treatments (Home Wash) | | | | | | |
|---|---|---|---|---|---|---|
| Repel-Water 30 Wash | 0 | 1 | 4 | 3 | 2.0 | 2.0 |
| Repel-Oil AR | 1 | 5 | 4 | 5 | 4.0 | 5.0 |
| Repel-Oil 5 Wash | 0 | 1 | N/A | N/A | N/A | 5.0 |
| Repel-Oil 10 Wash | 0 | 1 | 3 | 3 | 1.0 | 2.0 |
| Repel-Oil 20 Wash | 0 | 0 | 2 | 2 | 1.0 | 2.0 |
| Repel-Oil 30 Wash | 0 | 0 | 1 | 2 | 0.0 | 1.0 |
| Spray AR | 0 | 80 | 100 | 100 | 100 | 90 |
| Spray 5 Wash | 0 | 0 | N/A | N/A | N/A | 90 |
| Spray 10 Wash | 0 | 0 | 90 | 90 | 80 | 70 |
| Spray 20 Wash | 0 | 0 | 80 | 90 | 70 | 70 |
| Spray 30 Wash | 0 | 0 | 80 | 80 | 70 | 50 |
| Stain Release - Corn 0/1 0/2 | 3.5/4.0 | 4.0/3.5 | N/A | N/A | N/A | 4.0/4.5 |
| Stain Release - Corn 4/5 4/6 | 3.5/4.0 | 4.0/3.5 | N/A | N/A | 1.0/NA | 2.5/3.0 |
| Stain Release - Corn 9/10 9/11 | 3.0/3.5 | 3.5/NA | N/A | N/A | 2.5/NA | 3.0/NA |
| Stain Release - Corn 19/20 19/21 | 3.0/3.5 | 3.5/NA | N/A | N/A | 2.0/NA | 3.5/NA |
| Stain Release - Corn 29/30 29/31 | 3.0/3.5 | 3.5/NA | N/A | N/A | 2.0/NA | 3.0/NA |
| Stain Release - Mineral 0/1 0/2 | 3.5/3.5 | N/A | N/A | N/A | N/A | 3.5/4.0 |
| Stain Release - Mineral 4/5 4/6 | 3.5/3.5 | N/A | N/A | N/A | 1.5/NA | 1.0/1.5 |
| Stain Release - Mineral 9/10 9/11 | 3.0/3.5 | N/A | N/A | N/A | 2.0/NA | 2.5/NA |
| Stain Release - Mineral 19/20 19/21 | 3.0/3.5 | N/A | N/A | N/A | 1.0/NA | 3.0/NA |
| Stain Release - Mineral 29/30 29/31 | 3.0/3.5 | N/A | N/A | N/A | 1.0/NA | 2.0/NA |

| | Example | |
|---|---|---|
| | Ex. 14G | Ex. 14H |
| Testing Location | Lab | Lab |
| Trial Location | Lab | Lab |
| Repel-Water AR | 3 | 3 |
| Repel-Water 5 Wash | 4 | 4 |
| Repel-Water 10 Wash | 4 | 4 |
| Repel-Water 20 Wash | 3 | 3 |
| Repel-Water 30 Wash | N/A | N/A |
| Repel-Oil AR | 5 | 5 |
| Repel-Oil 5 Wash | 5 | 5 |
| Repel-Oil 10 Wash | 5 | 5 |
| Repel-Oil 20 Wash | 5 | 4 |
| Repel-Oil 30 Wash | N/A | N/A |
| Spray AR | 70 | 70 |
| Spray 5 Wash | 70 | 70 |
| Spray 10 Wash | 70 | 70 |
| Spray 20 Wash | 70 | 70 |
| Spray 30 Wash | N/A | N/A |
| Stain Release - Corn 0/1 | 5 | 4.5 |
| Stain Release - Corn 4/5 | 4.5 | 4 |
| Stain Release - Corn 9/10 | 4 | 4 |
| Stain Release - Corn 19/20 | 3.5 | 3.5 |
| Stain Release - Corn 29/30 | N/A | N/A |
| Stain Release - Mineral 0/1 | 5 | 4.5 |
| Stain Release - Mineral 4/5 | 5 | 4 |
| Stain Release - Mineral 9/10 | 4 | 3.5 |
| Stain Release - Mineral 19/20 | 4 | 3 |
| Stain Release - Mineral 29/30 | N/A | N/A |

Test results for Inventive Examples 15 and Comparative Examples 16 and 18 are shown in Table VIII and Table IX. The results for Example 15 illustrate the durability of the inventive chemistry on polyester and cotton blend fabric in maintaining high levels of water and oil repellency while at the same time maintaining acceptable levels of stain release through at least 30 industrial wash cycles. The results further show the versatility of the inventive chemistry in adding the permanent press resin to the fabric either before the inventive chemistry is fully cured or after the inventive chemistry is fully cured (i.e. postcure). Both processes provide high levels of water and oil repellency, acceptable levels of stain release, and acceptable levels of spray rating. The results further show the durability and effectiveness of the inventive chemistry used in Example 15A and 15B for burnt motor oil ("BMO") stain release on this polyester and cotton blend substrate after at least 30 industrial washes.

The results of Comparative Example 16 illustrate that the inventive chemistry, shown as Example 15A through 15E, provides durable repellency, spray rating, and stain release through at least 30 industrial wash cycles over the competitive chemistry, shown as Example 16A and 16B, provided herein for comparison on the same polyester cotton blend substrate.

The results of Example 17 illustrate the durability of the inventive chemistry on a nylon textile substrate through at least 10 home wash cycles when tested for spray rating and oil release by methods previously described.

The results of Comparative Example 18 illustrate the superior performance of the inventive chemistry on a nylon textile substrate over the competitive chemistry for spray rating and corn and mineral oil release through at least 10 home wash cycles.

TABLE IX

Nylon Textile Substrate with Inventive and Comparative Treatments (Home Wash)

| | Example | | | |
|---|---|---|---|---|
| | Ex. 17 | Ex. 18A | Ex. 18B | Ex. 18C |
| Oil Repellency: AR | N/A | N/A | N/A | N/A |
| Water Repellency: AR | N/A | N/A | N/A | N/A |
| Spray Rating: AR | 100 | 80 | 80 | 70 |
| Corn Oil Release: 0/1 | 3.5 | 3 | 4 | 5 |
| Mineral Oil Release: 0/1 | 3 | 3.5 | 4 | 5 |
| Oil Repellency: 5 Wash | N/A | N/A | N/A | N/A |
| Water Repellency: 5 Wash | N/A | N/A | N/A | N/A |
| Spray Rating: 5 Wash | 90 | N/A | 50 | 50 |
| Corn Oil Release: 4/5 | 4 | N/A | 3.5 | 5 |
| Mineral Oil release: 4/5 | N/A | N/A | 3.5 | 4.5 |

TABLE VIII

Textile Substrate with Inventive and Comparative Treatments (Industrial Wash)

| | Example | | | | | | |
|---|---|---|---|---|---|---|---|
| | Ex. 15A | Ex. 15B | Ex. 15C | Ex. 15D | Ex. 15E | Ex. 16A | 16B |
| Testing Location | Production | Production | Lab | Lab | Lab | Lab | Lab |
| Trial Location | Production | Production | Lab | Lab | Lab | Lab | Lab |
| Repel-Water AR | 6.0 | 5.0 | 10 | 10 | 10 | 3 | 7.5 |
| Repel-Water 5 Wash | 6.0 | 6.0 | 6.5 | 7 | 7.5 | 0 | 6.5 |
| Repel-Water 10 Wash | 5.0 | 5.0 | 4.5 | 6 | 6 | 0 | 6 |
| Repel-Water 20 Wash | 4.0 | 4.0 | 0 | 2.5 | 2.5 | 2.5 | 0 |
| Repel-Water 30 Wash | 2.0 | 2.0 | 0 | 2.5 | 0 | 0 | 0 |
| Repel-Oil AR | 6.0 | 5.0 | 7 | 6 | 6 | 5 | 5.5 |
| Repel-Oil 5 Wash | 5.0 | 5.0 | 5.5 | 5.5 | 6 | 1.5 | 4.5 |
| Repel-Oil 10 Wash | 5.0 | 5.0 | 5 | 4.5 | 5 | 1.5 | 3.5 |
| Repel-Oil 20 Wash | 4.0 | 4.0 | 2.5 | 2 | 2 | 5 | 0 |
| Repel-Oil 30 Wash | 1.0 | 1.0 | 1 | 1.5 | 1.5 | 2 | 0 |
| Spray AR | 80 | 80 | 70 | 70 | 70 | 50 | 100 |
| Spray 5 Wash | 70 | 70 | 50 | 50 | 50 | 50 | 25 |
| Spray 10 Wash | 70 | 70 | 50 | 50 | 50 | 0 | 0 |
| Spray 20 Wash | 50 | 70 | 50 | 50 | 50 | 0 | 0 |
| Spray 30 Wash | 50 | 70 | 50 | 50 | 0 | 0 | 0 |
| Stain Release - Corn 0/1 0/2 | 4/4.5 | 3.5/4.5 | 5/NA | 5/NA | 5/NA | 4.2/NA | 1/NA |
| Stain Release - Corn 4/5 4/6 | 3.5/4.5 | 4.0/4.5 | 5/NA | 5/NA | 5/NA | 4.8/NA | 1/NA |
| Stain Release - Corn 9/10 9/11 | 4.0/4.5 | 4.0/4.5 | 4.7/NA | 4.7/NA | 4.5/NA | 4.3/NA | 1/NA |
| Stain Release - Corn 19/20 19/21 | 4.0/4.5 | 4.0/4.5 | 4.2/NA | 4.3/NA | 4/NA | 4.3/NA | 1.5/NA |
| Stain Release - Corn 29/30 29/31 | 4.0/4.5 | 4.0/4.0 | 5/NA | 4.3/NA | 4.7/NA | 4.3/NA | 2.5/NA |
| Stain Release - Mineral 0/1 0/2 | 3.5/4.5 | 3.5/4.5 | 4.5/NA | 4.5/NA | 5/NA | 3.8/NA | 1/NA |
| Stain Release - Mineral 4/5 4/6 | 4.0/4.5 | 4.0/4.5 | 5/NA | 5/NA | 5/NA | 4.5/NA | 1/NA |
| Stain Release - Mineral 9/10 9/11 | 4.0/4.5 | 4.0/4.5 | 4.5/NA | 4/NA | 4.5/NA | 4.3/NA | 1/NA |
| Stain Release - Mineral 19/20 19/21 | 4.0/4.5 | 4.0/4.5 | 4/NA | 3.5/NA | 4/NA | 3.3/NA | 2.5/NA |
| Stain Release - Mineral 29/30 29/31 | 4.0/4.0 | 4.0/4.0 | 4.2/NA | 3.2/NA | 3.5/NA | 2.8/NA | 4/NA |
| Stain Release - BMO 0/1 0/2 | 3.5/4.5 | 3.5/4.5 | N/A | N/A | N/A | N/A | 1/NA |
| Stain Release - BMO 4/5 4/6 | 4.0/4.5 | 4.0/4.5 | N/A | N/A | N/A | N/A | 2.5/NA |
| Stain Release - BMO 9/10 9/11 | 4.0/4.5 | 4.0/4.5 | N/A | N/A | N/A | N/A | 4/NA |
| Stain Release - BMO 19/20 19/21 | 4.0/4.5 | 4.0/4.5 | N/A | N/A | N/A | N/A | N/A |
| Stain Release - BMO 29/30 29/31 | 4.0/4.5 | 4.0/4.5 | N/A | N/A | N/A | N/A | N/A |

TABLE IX-continued

| Nylon Textile Substrate with Inventive and Comparative Treatments (Home Wash) | Example | | | |
|---|---|---|---|---|
| | Ex. 17 | Ex. 18A | Ex. 18B | Ex. 18C |
| Oil Repellency: 10 Wash | N/A | N/A | N/A | N/A |
| Water Repellency: 10 Wash | N/A | N/A | N/A | N/A |
| Spray Rating: 10 Wash | 90 | 70 | N/A | N/A |
| Corn Oil Release: 9/10 | 4 | 2.5 | N/A | N/A |
| Mineral Oil Release: 9/10 | N/A | 2.5 | N/A | N/A |

Test results for Example 19 are shown in Table X. The results show improved corn oil and mineral oil release over the untreated Nomex® fabric. The results further illustrate the durability of the inventive chemistry on the Nomex® fabric through at least 5 home wash cycles when tested for repellency, stain release, and spray rating by methods previously described.

TABLE X

| Nomex ® Textile Substrate with Inventive Treatments (Home Wash) | Example | | |
|---|---|---|---|
| | Ex. 19A | Ex. 19B | Ex. 19C |
| Oil Repellency: AR | 6 | 6 | N/A |
| Water Repellency: AR | 6 | 6 | N/A |
| Spray Rating: AR | 70 | 100 | N/A |
| Corn Oil Release: 0/1 | 4 | 3.3 | 2.5 |
| Mineral Oil Release: 0/1 | 3.5 | 1.5 | 2 |
| Oil Repellency: 5 Wash | 5 | 5 | N/A |
| Water Repellency: 5 Wash | 6 | 6 | N/A |
| Spray Rating: 5 Wash | 70 | 100 | N/A |
| Corn Oil Release: 4/5 | 4.5 | 4 | N/A |
| Mineral Oil release: 4/5 | 4 | 1 | N/A |

III) Further Analyses Through Modifications of Test Methods

Example 20

To illustrate that the inventive chemistry additionally provides improved oil and water repellency, improved stain release, and improved spray rating on a variety of textile substrate types, several other textile substrates were treated with the inventive chemistry using the one step application procedure and compared against the same textile substrate in an untreated state.

The chemical composition used for these textile substrates was as follows:

1% Repearl F-89, a repellent agent;
5% Unidyne TG-992, a stain release agent; and
2% Witcobond W-293, a cross-linking agent.

Example 20A

A 100% acetate textile substrate made by Milliken & Company was used to test for oil and water repellency, spray rating, and corn and mineral oil stain release by methods previously described. The acetate was constructed of a 191 by 50 satin weave pattern and comprised of 75/19 denier bright (as opposed to dull) acetate warp yarns and 150/38 denier bright fill yarns. The acetate had a wet pickup of the chemical composition on the substrate of about 80%.

Example 20B

A 100% acrylic textile substrate purchased from a fabric store was used to test for oil and water repellency, spray rating, and corn and mineral oil stain release by methods previously described. The acrylic had a felt construction and exhibited a wet pickup of the chemical composition on the substrate of about 250%.

Example 20C

A 100% wool textile substrate purchased from a fabric store was used to test for oil and water repellency, spray rating, and corn and mineral oil stain release by methods previously described. The wool had a plain weave construction and exhibited a wet pickup of the chemical composition on the substrate of about 80%.

Example 20D

A 100% silk textile substrate purchased from a fabric store was used to test for oil and water repellency, spray rating, and corn and mineral oil stain release by methods previously described. The silk was raw silk having a woven construction similar to a taffeta fabric. The wet pickup of the chemical composition on the substrate was about 100%.

Test results for are shown in Table XI. The results for Example 20A illustrate that the treated acetate, when compared with untreated acetate, exhibits improved oil and water repellency. The results of Example 20B illustrate that the treated acrylic, when compared with untreated acrylic, exhibits improved oil repellency. The results of Example 20C illustrate that the treated wool, when compared with untreated wool, exhibits improved oil repellency and improved corn and mineral oil stain release. The results of Example 20D illustrate that the treated silk, when compared with untreated silk, exhibits improved oil and water repellency and improved spray rating.

TABLE XI

| Other Textile Substrates with Inventive Treatments | Example | | | |
|---|---|---|---|---|
| | Ex. 20A Treated/ Untreated | Ex. 20B Treated/ Untreated | Ex. 20C Treated/ Untreated | Ex. 20D Treated/ Untreated |
| Oil Repellency: AR | 3/0 | 6/0 | 5/0 | 6/0 |
| Water Repellency: AR | 9/0 | 0/0 | 1/1 | 9/0 |
| Spray Rating: AR | 0/0 | 0/0 | 70/70 | 70/0 |
| Corn Oil Release: 0/1 | 5/5 | 5/5 | 5/2 | 2/2 |
| Mineral Oil Release: 0/1 | 5/5 | 5/5 | 3.5/3 | 2/2 |

Example 21

Example 1 was repeated, except several other common laundry detergents were used in place of the Quick Dissolving Tide®. The detergents used were:

| | |
|---|---|
| Example 21A: | Mountain Spring Tide ® |
| Example 21B: | Cheer ® |
| Example 21C: | Tide Free Liquid ® |

-continued

| | |
|---|---|
| Example 21D: | Era ® |
| Example 21E: | All ® |
| Example 21F: | Downy ® (in the washer) and Quick Dissolving Tide ® |
| Example 21G: | Bounce ® (in the dryer) and Quick Dissolving Tide ® |

Test results for are shown in Table XII. The results illustrate that good stain release and acceptable levels of repellency and spray rating are obtained using a variety of different detergents and fabric softeners on the polyester substrate.

TABLE XII

Microdenier Polyester Textile Substrate with Inventive Treatments (Home Wash)

| | Example | | | | | | | |
|---|---|---|---|---|---|---|---|---|
| | Ex. 1 | Ex. 21A | Ex. 21B | Ex. 21C | Ex. 21D | Ex. 21E | Ex. 21F | Ex. 21G |
| Oil Repellency: AR | 5 | 5 | 5 | 5 | 5 | 5 | 5 | 5 |
| Water Repellency: AR | 9 | 7 | 7 | 7 | 8 | 7 | 6 | 6 |
| Spray Rating: AR | 80 | 70 | 70 | 70 | 70 | 70 | 70 | 70 |
| Corn Oil Release: 0/1 AR | 4.5 | 4 | 4 | 4 | N/A | N/A | 4 | 5 |
| Mineral Oil Release: 0/1 AR | 5 | 4 | 4 | 3.5 | N/A | N/A | 4 | 4 |
| Oil Repellency: 10 Wash | 4 | 1 | 1 | 2 | N/A | N/A | N/A | N/A |
| Water Repellency: 10 Wash | 7 | 1 | 2 | 3 | N/A | N/A | N/A | N/A |
| Spray Rating: 10 Wash | 70 | 50 | 50 | 70 | N/A | N/A | N/A | N/A |
| Corn Oil Release: 9/10 | 4.5 | 5 | 5 | 4 | N/A | N/A | N/A | N/A |
| Mineral Oil release: 9/10 | 4 | 4 | 4 | 4 | N/A | N/A | N/A | N/A |
| Oil Repellency: 20 Wash | 4 | 0 | 1 | 2 | N/A | N/A | N/A | N/A |
| Water Repellency: 20 Wash | 7 | 2 | 2 | 3 | N/A | N/A | N/A | N/A |
| Spray Rating: 20 Wash | 70 | 50 | 50 | 50 | N/A | N/A | N/A | N/A |
| Corn Oil Release: 19/20 | 4 | 4 | 4 | 5 | N/A | N/A | N/A | N/A |
| Mineral Oil Release: 19/20 | 3.5 | 4 | 3.5 | 5 | N/A | N/A | N/A | N/A |

Example 22

In order to determine how the inventive chemistry affects the hand (or feel) of the textile substrate, several textile substrates were treated as described below and were then subjected to testing using the Kawabata Evaluation System. The substrates tested and chemical compositions used are as follows:

| | |
|---|---|
| Example 22A: | Example 1 was repeated. |
| Example 22B: | Example 6B was repeated |
| Example 22C: | The textile substrate described in Example 1 was untreated as a control. |

Test results are shown in Table XIII. Lower values for Bending Stiffness are indicative of a more supple hand. The results illustrate that the inventive chemistry does not detrimentally affect the hand of the polyester fabric and actually may slightly improve the hand when tested using Kawabata measurements.

TABLE XIII

Kawabata Hand Testing For Microdenier Polyester Textile Substrate

| | Example | | |
|---|---|---|---|
| | Ex. 22A | Ex. 22B | Ex. 22C |
| % Compressibility | 45.1 | 32.7 | 34.1 |
| Mean Bending Stiffness per unit width: Warp | 0.058 | 0.141 | 0.052 |

TABLE XIII-continued

Kawabata Hand Testing For Microdenier Polyester Textile Substrate

| | Example | | |
|---|---|---|---|
| | Ex. 22A | Ex. 22B | Ex. 22C |
| Mean Bending Stiffness per unit width: Fill | 0.093 | 0.093 | 0.073 |
| Mean Shear Stiffness: Warp | 0.622 | 0.884 | 0.536 |
| Mean Shear Stiffness: Fill | 0.498 | 0.614 | 0.392 |
| Tensile Work (during extension): Warp | 12.3 | 13.9 | 20.5 |
| Tensile Work (during extension): Fill | 6.3 | 6.4 | 13.2 |
| Mean Coefficient of Friction: Warp | 0.215 | 0.284 | 0.275 |
| Mean Coefficient of Friction: Fill | 0.236 | 0.311 | 0.280 |

Example 23

Durability to dry cleaning was tested on microdenier polyester fabric treated with the inventive chemical composition, as well as with several competitive chemical compositions according to the previously described dry cleaning procedure. The treated fabrics were tested for oil and water repellency and spray rating before any dry cleaning cycles ("as received"), after 1 dry cleaning cycle, after 5 dry cleaning cycles, and after 5 dry cleaning cycles and ironing. The substrates tested were as follows:

| | |
|---|---|
| Example 23A: | Example 1 was repeated |
| Example 23B: | Example 6B was repeated |
| Example 23C: | Example 6C was repeated |

Test results are shown in Table XIV. The results illustrate that the inventive chemistry is able to withstand the process of dry cleaning and the process of dry cleaning and ironing and still maintain some level of durability through at least 5 dry cleaning cycles.

TABLE XIV

Microdenier Polyester Textile Substrate with Inventive and Comparative Treatments (Dry Cleaning)

| | Example | | | | | |
|---|---|---|---|---|---|---|
| | Ex. 23A | Ex. 23B | Ex. 23C | Ex. 23D | Ex. 23E | Ex. 23F |
| Oil Repellency: AR | 5 | 5 | 4 | 4 | 5 | 5 |
| Water Repellency: AR | 7 | 7 | 2 | 1 | 6 | 1 |
| Spray Rating: AR | 70 | 100 | 70 | 70 | 100 | 70 |
| Oil Repellency: 1 Cycle | 2 | 5 | 4 | 5 | 5 | 4 |
| Water Repellency: 1 Cycle | 3 | 8 | 1 | 2 | 5 | 2 |
| Spray Rating: 1 Cycle | 70 | 90 | 70 | 70 | 100 | 70 |
| Oil Repellency: 5 Cycles | 2 | 5 | 5 | 4 | 4 | 4 |
| Water Repellency: 5 Cycles | 5 | 4 | 1 | 1 | 5 | 2 |
| Spray Rating: 5 Cycles | 50 | 80 | 50 | 50 | 100 | 50 |

Example 24

Another test was performed to determine the air permeability of microdenier polyester textile substrate treated with the inventive chemistry of the current invention. The treated polyester fabric was compared with untreated polyester fabric and with the same fabric having a competitive chemical composition applied to it. The test was performed in accordance with ASTM Test Method D737-96 with air pressure at 125 Pa (Pascals), and the results are given in "cfm" (cubic feet per minute) units. The textile substrates tested and the chemistry used are as follows:

| | |
|---|---|
| Example 24A: | Example 1 was repeated |
| Example 24B: | Example 6B was repeated |
| Example 24C: | The textile substrate described in Example 1 was untreated as a control. |

Test results are shown in Table XV. The results illustrate that air permeability was not significantly affected by treatment with the inventive chemistry. The results further show that air permeability was better with the inventive chemistry when compare with the same fabric treated with competitive chemistry.

TABLE XV

Breathability of Inventive Microdenier Polyester Textile Substrate

| | Example | | |
|---|---|---|---|
| | Ex. 24A | Ex. 24B | Ex. 24C |
| Air Permeability (CFM) | 21.7 | 16.3 | 19.4 |

Example 25

Another test was performed to determine the effect the inventive chemistry has on static charge for microdenier polyester textile substrate. The treated polyester fabric was compared with untreated polyester fabric and with the same fabric having a competitive chemical composition applied to it. The test was performed according to the previously described procedure. The results are given in "kV" (kilovolts) before home washing ("AR" means as received"), after 1 home wash cycle, after 5 home wash cycles, and after 5 home wash cycles and conditioning the substrate to 70° F. and 65% relative humidity ("RH"). "NR" indicates that the static charge exceeded the meter's capability to measure the charge. The textile substrates tested and the chemistry used are as follows:

| | |
|---|---|
| Example 25A: | Example 1 was repeated |
| Example 25B: | Example 6B was repeated |
| Example 25C: | The textile substrate described in Example 1 was left untreated as a control. |

Test results are shown in Table XVI. The results illustrate that after 5 washes with conditioning the polyester substrate treated with inventive chemistry actually reduces the static charge on the substrate. The results further show that the polyester substrate treated with inventive chemistry created less static charge than the same fabric treated with competitive chemistry with no washes and after 5 washes with conditioning. Additionally, the polyester substrate treated with inventive chemistry created less static charge than the untreated polyester substrate after 1 wash and after 5 washes with conditioning.

Furthermore, all the results, except for the polyester substrate treated with inventive chemistry after 5 washes and conditioning, measured some degree of static charge, which indicates that the substrates exhibit undesirable static cling properties. The only sample that did not exhibit any static cling was the polyester substrate treated with inventive chemistry after 5 washes and conditioning. Since durable antistatic and anticling protection is difficult to achieve on polyester substrates, especially microdenier polyester substrates, these results show yet another advantage of using the inventive chemistry of the current invention on various substrates.

TABLE XVI

Static Charge on Inventive Microdenier Polyester Textile Substrate

| | Example | | |
|---|---|---|---|
| | Ex. 25A | Ex. 25B | Ex. 25C |
| Static Charge: AR | 3.9 kV | NR | 0.3 kV |
| Static Charge: 1 Wash | 8.4 kV | 2.4 kV | NR |
| Static Charge: 5 Wash | 4.9 kV | 1.9 kV | 2.4 kV |
| Static Charge: 5 Wash & conditioned at 70° F., 65% RH | −0.33 kV | NR | 1.69 kV |

Example 26

Advancing and receding contact angles were measured for a polyester substrate treated with various inventive and competitive chemical compositions using the Goniometer and Tensiometer Test Methods previously described. The chemical compositions were as follows:

| | |
|---|---|
| Example 26A: | Example 1 was repeated on a polyester film and on the polyester/cotton blend fabric described in Example 13, and the contact angles were measured |
| Example 26B: | Example 26A was repeated on the polyester film, with only the stain release chemical agent, 4.5% Unidyne TG-992, and the contact angles were measured. |
| Example 26C: | Example 26A was repeated on the polyester film, with only the stain repellent chemical agent, 1.5% Repearl F8025, and the contact angles were measured. |
| Example 26D: | Example 6B was repeated on the microdenier polyester fabric, and the contact angles were measured. |
| Example 26E: | Example 6C was repeated on a polyester film and on the polyester/cotton blend fabric of Example 13, and the contact angles were measured. |
| Example 26F: | The substrate described in Example 26A (polyester film) was left untreated as a control, and the contact angles were measured. |

Test results are shown in Table XVII. The results indicate improved stain resistance and improved stain release is expected for the chemical composition of the current invention when compared with traditional fluorochemical repellents (Ex. 26B). The results also illustrate that improved aqueous stain resistance is expected when compared with newer repellents (Ex. 26C). Further, the results also show the advancing contact angle is dominated by Repearl F8025 (the stain repellent chemical agent), and the receding contact angle is dominated by Unidyne TG-992 (the release chemical agent), thereby providing further support of the chemical composition auto adapting to changes in its environment. Finally, the results show that the composition of the current invention yields similar results on both natural and synthetic fibers, as well as on films in addition to textile substrates.

TABLE XVII

Contact Angle Measurements For Inventive Microdenier Polyester Textile Substrate

| | Example | | | | | |
|---|---|---|---|---|---|---|
| | Ex. 26A | Ex. 26B | Ex. 26C | Ex. 26D | Ex. 26E | Ex. 26F |
| Advancing Contact Angle: Goniometer | 143 | 106 | 117 | N/A | 110 | 81 |

TABLE XVII-continued

Contact Angle Measurements For Inventive Microdenier Polyester Textile Substrate

| | Example | | | | | |
|---|---|---|---|---|---|---|
| | Ex. 26A | Ex. 26B | Ex. 26C | Ex. 26D | Ex. 26E | Ex. 26F |
| Receding Contact Angle: Gonimeter | 49 | 51 | 95 | N/A | 64 | 58 |
| Advancing Contact Angle: Tensiometer | 167 | N/A | N/A | 167 | 159 | N/A |
| Receding Contact Angle: Tensiometer | 109 | N/A | N/A | 124 | 81 | N/A |

Example 27

Using the contact and receding angle data shown in Example 26, surface energy was calculated, both at 25° C. and 40° C., for the microdenier polyester substrate treated with various inventive and competitive chemical compositions. The results are given in units of millijoules per square meter. The surface energy at 40° C. was determined, using the same measurement technique, but the sample was soaked in water for 1 hour at 40° C. and vacuum dried, prior to testing. The chemical compositions were as follows:

| | |
|---|---|
| Example 27A: | Example 1 was repeated, and the surface energy was determined. |
| Example 27B: | Example 1 was repeated, with only the stain release chemical agent, 4.5% Unidyne TG-992, and the surface energy was determined. |
| Example 27C: | Example 1 was repeated, with only the stain repellent chemical agent, 1.5% Repearl F8025, and the surface energy was determined. |
| Example 27D: | Example 6D was repeated, and the surface energy was determined. |
| Example 27E: | Example 6E was repeated, and the surface energy was determined. |
| Example 27F: | Example 6I was repeated, and the surface energy was determined. |

Test results are shown in Table XVIII. The results reflect the unique surface energy change obtained from the composition of the current invention, as a result of a change in the environment. The inventive chemical composition of the current invention is the only composition that exhibits the change from a low energy surface to a high energy surface as a result of environmental effects. This surface energy change is representative of the requirements of a durable stain repellent and stain release composition or treated surface.

TABLE XVIII

Surface Energy Measurements For Inventive Microdenier Polyester Textile Substrate

| | Example | | | | | |
|---|---|---|---|---|---|---|
| | Ex. 27A | Ex. 27B | Ex. 27C | Ex. 27D | Ex. 27E | Ex. 27F |
| Surface Energy at 25° C. | 14.2 $MJ/M^2$ | 17.0 $MJ/M^2$ | 14.8 $MJ/M^2$ | 22.1 $MJ/M^2$ | 18.8 $MJ/M^2$ | 16.2 $MJ/M^2$ |
| Surface Energy at 40° C. | 24.4 $MJ/M^2$ | 20.2 $MJ/M^2$ | 20.4 $MJ/M^2$ | wets | 18.1 $MJ/M^2$ | 17.0 $MJ/M^2$ |

Example 28

Surface chemical analysis for fluorine, carbon, and oxygen was performed on microdenier polyester fabric treated with the inventive chemistry of the current invention and with various competitive chemistry using XPS analytical techniques. The chemical compositions applied to the fabric were as follows:

| | |
|---|---|
| Example 28A: | Example 6C was repeated. |
| Example 28B: | Example 1 was repeated. |
| Example 28C: | Example 6I was repeated. |
| Example 28D: | Example 6D was repeated. |
| Example 28E: | Example 6B was repeated. |

Test results for Example 28 are shown in Table XIX and in FIGS. 1-3.

TABLE XIX

Surface Chemical Analysis For Inventive Microdenier Polyester Textile Substrate

| | Example | | | | |
|---|---|---|---|---|---|
| | Ex. 28A | Ex. 28B | Ex. 28C | Ex. 28D | Ex. 28E |
| Air Heat (370 degrees F.) as received: | | | | | |
| % Fluorine | 39.1 | 44.76 | 40.54 | 36.52 | 52.85 |
| % Carbon | 43.18 | 45.96 | 49.49 | 48.44 | 39.45 |
| % Oxygen | 14.03 | 9.29 | 9.97 | 13.77 | 4.71 |
| Soak in 40 degree C. water for 1 hour/vacuum dry: | | | | | |
| % Fluorine | 38.64 | 37.83 | 31.16 | 27.52 | 52.59 |
| % Carbon | 43.13 | 50.36 | 58.06 | 55.86 | 42.49 |
| % Oxygen | 14.55 | 11.19 | 10.77 | 16.62 | 4.92 |
| Reheat to 150 degrees C.: | | | | | |
| % Fluorine | 36.97 | 44.82 | 45.04 | N/A | N/A |
| % Carbon | 44.79 | 45.42 | 45.87 | N/A | N/A |
| % Oxygen | 14 | 9.77 | 9.09 | N/A | N/A |
| After 10 Washes: | | | | | |
| % Fluorine | 40.53 | 36.89 | 24.4 | 8.86 | 40.41 |
| % Carbon | 45.59 | 50.79 | 58.76 | 68.69 | 49.14 |
| % Oxygen | 13.88 | 12.32 | 16.84 | 8.86 | 8.2 |
| % loss of Fluorine | +3.70% | −17.60% | −39.80% | −75.70% | −23.50% |

DETAILED DESCRIPTION OF THE DRAWINGS

As seen in Table XIX and FIG. 1, the fluorine containing segment and the oxygen containing segment at the surface remain relatively constant for the treatment used for example 28A, regardless of the samples exposure to water or heat. However, the fluorine decreases, and the oxygen increases for the treatment of Example 28B (inventive chemistry) when the sample is exposed to water and returns to essentially the original values after heating the sample. Without being bound by theory, this may indicate that, in the presence of water and especially at 40° C., the ethylene oxide segment of Unidyne TG-992 is hydrated and swells sufficiently to predominate over the fluorinated segment. This may explain the surface energy changes that are shown to occur, as well as the excellent stain repellency and stain release of the chemical composition of the current invention. Upon subsequent heating, the polymer resumes its original configuration.

FIG. 1 further illustrates that Example 28A and 28E do not show the environmental response to water at 40° C. as shown for Example 28B. Examples 28C and 28D show a similar environmental response to Example 28B (inventive chemistry). However, as seen in FIG. 2, considerably more fluorine is lost from Example 28C and 28D than from Example 28B (inventive chemistry) after 10 home washes. This is especially true for example 28D and indicates a lack of durability for these treatments.

IV) Further Analysis of Different Fabric Types

Example 29

A suit fabric comprised of about 65% polyester fiber and about 35% wool fiber was tested using the inventive chemistry and competitive chemistry according to the Home Dryer Application Procedure previously described (and generally exemplified within U.S. Pat. Nos. 5,630,828, 5,591,236, and/or 5,951,716). The treated fabrics were tested for corn oil stain release, water repellency, and oil repellency as described previously. An untreated control fabric was also tested. The chemical compositions used for treatment were as follows:

| | |
|---|---|
| Example 29A: | An untreated piece of fabric (control). |
| Example 29B: | 5% Unidyne TG-992 |
| Example 29C: | 5% Unidyne TG-992<br>1% Repearl F-89 |

Test results are shown in Table XX. The results illustrate that stain release and stain repellent chemistry can be added to a textile substrate using the Home Dryer Application Procedure to provide corn oil stain release and water and oil repellency properties. The results further show the versatility and ease with which such chemistry may be applied to a substrate to obtain such stain release and repellency characteristics.

TABLE XX

Polyester and Wool Blend Textile Substrate with Inventive and Comparative Treatments Applied By Home Dryer Application Method

| | Example | | |
|---|---|---|---|
| | Ex. 29A | Ex. 29B | Ex. 29C |
| Stain Release: Corn Oil (0/1) | 1 | 3 | 3 |
| Water Repellency: AR | 0 | 1 | 2 |
| Oil Repellency: AR | 0 | 6 | 4 |

Accordingly, although it has been known to use fluorocarbon polymers and hydrophilic stain release polymers, together or separately, in order to obtain water and oil repellency and stain release performance characteristics on a substrate, it has proven difficult to obtain those characteristics simultaneously and with lasting durability following exposure to repeated home and industrial wash cycles. Because the polymers have a tendency to work against each other and to wash off the substrate during laundering, it has been surprising to find stain repellent chemical agents, stain release chemical agents, and hydrophobic cross-linking agents that work well together as shown in Examples 1 through 18. The concentration of the respective chemical agents which comprise the chemical composition used to treat a substrate, in combination with the unique ratio of the chemical agents to each other, and the careful selection of chemical agents, all seem to play a significant role in determining the success of the process and product, particularly with respect to durability.

In one or more preferred embodiments of the invention, the chemical composition may be applied to the substrate in a one step application process, a two step application process, or in an alternative two step application process as described previously. Indeed, as shown in the Examples, polyamides, polyaramids, polyesters, cottons, and polyester and cotton blend substrates, when treated according to the present invention, have all yielded improved performance with respect to durable water and oil repellency and durable stain release characteristics.

Accordingly, the treated substrate of the present invention has many applicable uses for incorporation into articles of apparel, such as outerwear (e.g., rainwear), workwear (e.g., uniforms), fashion apparel (e.g., shirts, pants, and other garments); drapery; napery (e.g., table linens and napkins); residential upholstery; commercial upholstery; automotive upholstery; carpeting; outdoor fabric (e.g., outdoor furniture, awnings, boat covers, and grill covers), and any other article wherein it is desirable to manufacture a substrate having durable water and oil repellency and durable stain release characteristics.

These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the scope of the invention described in the appended claims.

We claim:

1. A fabric substrate comprised of at least 20% cotton fiber by weight of the total weight of said substrate, wherein said substrate has a first surface and a second surface, wherein at least one of said first surface and said second surface has been coated with a hydrophilic fluorine-containing stain release agent, a hydrophobic fluorine-containing stain repellent agent and a hydrophobic cross-linking agent selected from the group consisting of monomers with blocked isocyanates, aromatic diisocyanates, blocked diisocyanates, blocked isocyanate-containing polymers, diisocyanate-containing monomers, and diisocyanate-containing polymers; and wherein said substrate exhibits a change in surface energy in response to a change in the substrate's environment to the extent that upon exposure to a temperature of 25 degrees C. the measured surface energy is from less than about 20 millijoules per square meter, and upon exposure to a temperature of 40 degrees C., the measured surface energy is greater than about 20 millijoules per square meter.

2. The fabric substrate of claim 1, wherein said substrate is at least 35% cotton by weight.

3. The fabric substrate of claim 2, wherein said substrate is a blend of cotton and at least one other fiber.

4. The fabric substrate of claim 3, wherein said fabric substrate is a woven polyester and cotton blend fabric.

5. The fabric substrate of claim 1, wherein said substrate is 100% cotton by weight.

6. The fabric substrate of claim 5, wherein said fabric substrate is a woven cotton fabric.

7. The fabric substrate of claim 1, wherein said substrate exhibits durable oil and water repellency and stain release characteristics.

8. A fabric substrate comprised of at least 20% cotton fiber by weight of the total weight of said substrate, wherein said substrate has a first surface and a second surface, wherein at least one of said first surface and said second surface has been coated with a hydrophilic fluorine-containing stain release agent, a hydrophobic fluorine-containing stain repellent agent and a hydrophobic cross-linking agent selected from the group consisting of monomers with blocked isocyanates, aromatic diisocyanates, blocked diisocyanates, blocked isocyanate-containing polymers, diisocyanate-containing monomers, and diisocyanate-containing polymers; and wherein said substrate exhibits an oil repellency rating of at least 3.0 when tested by AATCC Test Method 118-2000; a water repellency rating of at least 3.0 when tested by the 3M Water Repellency Test II (May, 1992); a spray rating of at least 50 when tested by AATCC Test Method 22-2000; and a stain release rating for corn oil and mineral oil of at least 3.5 when tested by AATCC Test Method 130-2000;

wherein said properties are exhibited after said test fabric has been laundered and dried in accordance with AATCC Test Method 130-2000 after 20 washes.

9. A fabric substrate comprised of at least 20% cotton fiber by weight of the total weight of said substrate, wherein said substrate has a first surface and a second surface, wherein at least one of said first surface and said second surface has been coated with a hydrophilic fluorine-containing stain release agent, a hydrophobic fluorine-containing stain repellent agent and a hydrophobic cross-linking agent selected from the group consisting of monomers with blocked isocyanates, aromatic diisocyanates, blocked diisocyanates, blocked isocyanate-containing polymers, diisocyanate-containing monomers, and diisocyanate-containing polymers; and wherein said substrate exhibits an oil repellency rating of at least 3.0 when tested by AATCC Test Method 118-2000; a water repellency rating of at least 3.0 when tested by the 3M Water Repellency Test II (May, 1992); a spray rating of at least 50 when tested by AATCC Test Method 22-2000; and a stain release rating for corn oil and mineral oil of at least 3.5 when tested by AATCC Test Method 130-2000;

wherein said properties are exhibited after said test fabric has been subjected to at least 5 dry cleaning cycles.

* * * * *